US010143261B2

(12) United States Patent
Perkins et al.

(10) Patent No.: US 10,143,261 B2
(45) Date of Patent: Dec. 4, 2018

(54) SHOE WITH MAGNETIC ATTACHMENT MECHANISM

(71) Applicant: CAT PERKINS INC., New York, NY (US)

(72) Inventors: Deborah Hower Perkins, New York, NY (US); Catherine Levene, New York, NY (US); Mohamed Abdelhafez, Spotswood, NJ (US); Renata Squeo, Millstone Township, NJ (US); Geoffrey M. Engelstein, Bridgewater, NY (US)

(73) Assignee: CAT PERKINS INC., New York, NY (US)

( * ) Notice: Subject to any disclaimer, the term of this patent is extended or adjusted under 35 U.S.C. 154(b) by 12 days.

(21) Appl. No.: 14/455,048

(22) Filed: Aug. 8, 2014

(65) Prior Publication Data

US 2015/0040434 A1 Feb. 12, 2015

Related U.S. Application Data

(60) Provisional application No. 61/863,734, filed on Aug. 8, 2013.

(51) Int. Cl.
*A43B 3/24* (2006.01)
*A43B 3/12* (2006.01)
(Continued)

(52) U.S. Cl.
CPC ..... *A43B 3/244* (2013.01); *A43B 1/0054* (2013.01); *A43B 3/12* (2013.01); *A43B 3/122* (2013.01);
(Continued)

(58) Field of Classification Search
CPC ..... A43B 3/24; A43B 1/0054; A43B 3/244; A43B 3/103; A43B 3/12; A43B 3/00;
(Continued)

(56) References Cited

U.S. PATENT DOCUMENTS 2,607,133 A * 8/1952 Marlowe ..... A43B 3/24 36/101
3,141,216 A * 7/1964 Haskell ..... A41F 1/002 24/303

(Continued)

OTHER PUBLICATIONS

PCT Search Report and Written Opinion dated Nov. 26, 2014 issued for International PCT Application No. PCT/US14/50398 filed Aug. 8, 2014.

(Continued)

*Primary Examiner* — Katharine Gracz
(74) *Attorney, Agent, or Firm* — K&L Gates LLP

(57) ABSTRACT

A system and method for customizing footwear with interchangeable straps and soles is provided. In one embodiment, an article of footwear includes an upper assembly with at least one fastener. The fastener of the upper assembly can be inserted into a lower assembly and magnetically attracted to a fastener of the lower assembly so as to removably attach the upper assembly to the lower assembly. The removable attachment of the upper assembly to the lower assembly allows for interchangeability with other lower assemblies and upper assemblies, allowing the article of footwear to be quickly customized to several different styles and/or colors of footwear for different occasions.

17 Claims, 27 Drawing Sheets

(51) Int. Cl.
*A43B 1/00* (2006.01)
*A43B 13/36* (2006.01)

(52) U.S. Cl.
CPC ..... *A43B 3/24* (2013.01); *A43B 3/242* (2013.01); *A43B 13/36* (2013.01)

(58) Field of Classification Search
CPC . Y10T 24/309; Y10T 24/42; Y10T 24/44026; F16B 21/07; F16B 21/08
USPC ..... 36/15, 101, 11.5; 24/303, 317, 358, 356
See application file for complete search history.

(56) References Cited

U.S. PATENT DOCUMENTS 3,983,642 A * 10/1976 Liao ..... A43B 3/24 36/101
4,450,633 A * 5/1984 Connelly ..... 36/101
4,716,633 A * 1/1988 Rizo ..... B60R 13/0206 24/297
6,170,131 B1 * 1/2001 Shin ..... A41F 1/002 24/303
6,349,486 B1 * 2/2002 Lin ..... A43B 3/122 36/101
6,640,398 B2 * 11/2003 Hoffman ..... A44B 5/00 24/303
6,640,464 B2 * 11/2003 Hsin ..... A43B 3/122 36/101
6,928,754 B2 * 8/2005 Cambronero ..... A43B 3/122 36/100
7,171,768 B2 2/2007 Klein
7,219,445 B2 * 5/2007 Stern et al. ..... 36/11.5
7,222,441 B2 * 5/2007 Smith ..... A43B 3/103 36/100
D590,704 S * 4/2009 Brunsteter ..... D8/387
7,819,721 B1 * 10/2010 Messier ..... 450/86
D659,217 S * 5/2012 ReDavid, III ..... D22/107
8,201,347 B2 6/2012 Garza
8,434,246 B2 5/2013 Enderson
D752,962 S * 4/2016 Cottier ..... D8/385
2006/0112597 A1 * 6/2006 Stern et al. ..... 36/101
2007/0094897 A1 * 5/2007 Nakatsu ..... 36/100
2007/0130802 A1 * 6/2007 Condie ..... 36/101
2007/0240336 A1 * 10/2007 Richardson ..... 36/101
2008/0047111 A1 * 2/2008 Garber ..... A44C 5/2061 24/303
2008/0060110 A1 * 3/2008 Schmelzer et al. ..... 2/69
2008/0072456 A1 * 3/2008 Pearce ..... 36/101
2008/0098623 A1 * 5/2008 Komitau ..... 36/101
2009/0229145 A1 9/2009 Ortner
2010/0263237 A1 * 10/2010 Cuellar et al. ..... 36/136
2011/0214224 A1 * 9/2011 Maddux ..... A42B 3/20 2/424
2012/0137543 A1 * 6/2012 Kemp ..... 36/100
2012/0260530 A1 * 10/2012 Policastro ..... 36/101
2013/0263432 A1 * 10/2013 Goldberg ..... B43M 15/00 29/525.03

OTHER PUBLICATIONS

Written Opinion of the International Preliminary Examining Authority for PCT/US2014/050398 dated Sep. 15, 2015 (8 pages).
Chinese Office Action for Application No. 201430049379.3 dated Feb. 24, 2017—7 pgs.
Chinese Office Action for Application No. 201430049379.3 dated Feb. 24, 2017 (English translation)—11 pgs.
Chinese Office Action issued for related Chinese Patent Application No. 201480049379.3 dated Oct. 26, 2017 and English translation of same.

* cited by examiner

SHOE WITH MAGNETIC ATTACHMENT MECHANISM

CROSS REFERENCE TO RELATED APPLICATIONS

This application claims priority to and the benefit of U.S. Provisional Application No. 61/863,734, filed Aug. 8, 2013, the entire content of which is hereby incorporated by reference.

FIELD OF THE INVENTION

The present disclosure relates generally to footwear, and more specifically, to footwear that can be customized with interchangeable straps and soles.

BACKGROUND

Footwear comes in a variety of styles, colors and designs to suit various functional and aesthetic goals. Oftentimes, consumers wish to coordinate their footwear to match their outfit. Consumers also require different styles of footwear for formal and informal occasions. This can lead to the need for consumers to own a variety of colors and styles of footwear so that the proper footwear can be chosen to match any color or style of outfit for any formal or informal occasion. This, however, can be very expensive and can lead to difficulty storing numerous pairs of footwear in one's home. This can also lead to storage problems when packing for a trip as several pairs of footwear may need to be stored in luggage if a consumer is unsure what style and/or color footwear will be needed for an out-of-town event. A need therefore exists for a system and method to reduce the sheer number of pairs of shoes needed to match any color or style of outfit for any formal or informal occasion.

Another current problem with footwear is that it can quickly wear out when worn frequently by a consumer. In most cases, when footwear becomes worn-out, it must be replaced in its entirety. In some cases, a consumer may simply be able to replace a shoelace or a sole of the footwear to continue to use the footwear after it has become worn-out, but only certain styles of shoes allow for such a substitution. With respect to open-toed shoes and sandals that do not use shoelaces, there are very few options available to allow a consumer to easily replace the straps of the shoe without destroying the entire shoe. A need therefore exists for footwear which allows a portion of the footwear to be replaced while also allowing for a portion of the footwear to be saved.

Shoes with removable straps have been proposed to provide consumers with the opportunity to use different straps with a single shoe base. However, the straps are attached to the shoe base with screws or other devices that are unsightly and require special tooling to use. A need therefore exists for removable straps that are easy to attach and remove and do not require special tooling for attachment or removal.

SUMMARY

The present disclosure relates to a system and method for customizing footwear with interchangeable straps or other uppers and soles. In an example embodiment of the present disclosure, an article of footwear includes a lower assembly including at least one first fastener, and an upper assembly including at least one second fastener, at least one of the first fastener and the second fastener including a magnet, wherein the second fastener is positioned and arranged to be inserted into the lower assembly and to magnetically attach to the first fastener when inserted into the lower assembly so as to removably attach the upper assembly to the lower assembly.

In another example embodiment of the present disclosure, an article of footwear includes a lower assembly including at least one magnet, and an upper assembly including at least one pin, the pin positioned and arranged to be inserted into the lower assembly and held in place in the lower assembly by a magnetic force provided by the magnet.

In another embodiment of the present disclosure, a method of preparing an article of footwear to be worn includes selecting a lower assembly, the lower assembly including at least one magnet, selecting an upper assembly, the upper assembly including at least one pin, and inserting the pin into a clearance aperture in the lower assembly so as to removably attach the upper assembly to the lower assembly using a magnetic force provided by the magnet.

In another embodiment, an article of manufacture includes a lower assembly including at least one magnet and at least one clearance aperture, a first upper assembly including at least one first aperture, a second upper assembly including at least one second aperture, at least one pin, the pin capable of being (1) inserted through the at least one first aperture and the at least one clearance aperture to removably attach the first upper assembly to the lower assembly using a magnetic force provided by the magnet and (2) inserted through the at least one second aperture and the at least one clearance aperture to removably attach the second upper assembly to the lower assembly using the magnetic force provided by the magnet, and a unifying container containing the lower assembly, the first upper assembly, and the second upper assembly.

In another example embodiment, an article of manufacture includes a lower assembly including at least one magnet and at least one clearance aperture, a first upper assembly including at least one first pin, a second upper assembly including at least one second pin, wherein the at least one first pin is positioned and arranged to be inserted into the at least one clearance aperture to removably attach the first upper assembly to the lower assembly using a magnetic force provided by the magnet, and wherein the at least one second pin is positioned and arranged to be inserted into the at least one clearance aperture to removably attach the first upper assembly to the lower assembly using a magnetic force provided by the magnet, and a unifying container containing the lower assembly, the first upper assembly, and the second upper assembly.

In another embodiment, an article of footwear includes a lower assembly, an upper assembly, at least one fastener for removably attaching the upper assembly to the lower assembly, means for inserting at least a portion of the at least one fastener into the lower assembly, and means for magnetically attaching the at least one fastener to the lower assembly.

BRIEF DESCRIPTION OF THE FIGURES

Embodiments of the present disclosure will now be explained in further detail by way of example only with reference to the accompanying figures, in which.

DETAILED DESCRIPTION

The present disclosure relates to a system and method for customizing footwear with interchangeable straps or other uppers and soles. In an example embodiment, an article of footwear includes two assemblies, an upper assembly and a lower assembly. The lower assembly is the portion of the article of footwear that is located underneath and supports the weight of a person's foot in use. The upper assembly is the portion of the article of footwear that is located on top of a person's foot and holds the lower assembly to the person's foot. Both the lower assembly and the upper assembly include at least one respective fastener. The fastener of the lower assembly is preferably included inside of the lower assembly so as to not be visible from outside the footwear. The fastener of the upper assembly is preferably a pin that can be inserted into a clearance aperture in the lower assembly. At least one of the fasteners of the lower assembly or the upper assembly includes a magnet, preferably the fastener in the lower assembly. The corresponding fastener includes a ferromagnetic material that tends to be attracted to the magnet. In use, the fastener with the magnet magnetically attracts the other of the fasteners so as to removably attach the upper assembly to the lower assembly and provide a complete article of footwear. The removable attachment of the lower assembly to the upper assembly allows for interchangeability with other lower assemblies and upper assemblies. A single lower assembly could be interchanged with multiple upper assemblies, and vice versa, to give a person several different styles and/or colors of shoes, which eliminates the cost and storage problems described above. The magnetic attachment allows a person to quickly interchange lower assemblies and upper assemblies without having to deal with bulky and unsightly screws and clamps along with screwdrivers and other special tools necessary to adjust such screws and clamps.

For example, a person could store three pairs of lower assemblies and three pairs of upper assemblies (i.e., three pairs of complete shoes). Because any of the three pairs of lower assemblies could be interchanged with any of the three pairs of upper assemblies, the person essentially has nine different style/color shoes that can be worn at any time. Thus, the person only has to purchase and store three pairs of shoes instead of nine pairs of shoes to obtain the same number of different options of shoes to wear. If a person stores four pairs of lower assemblies and four pairs of upper assemblies (i.e., four pairs of complete shoes), then the person essentially has sixteen different style/color shoes that can be worn at any time. The potential number of combinations increases exponentially as more and more lower assemblies and upper assemblies are stored.

Figure 1:
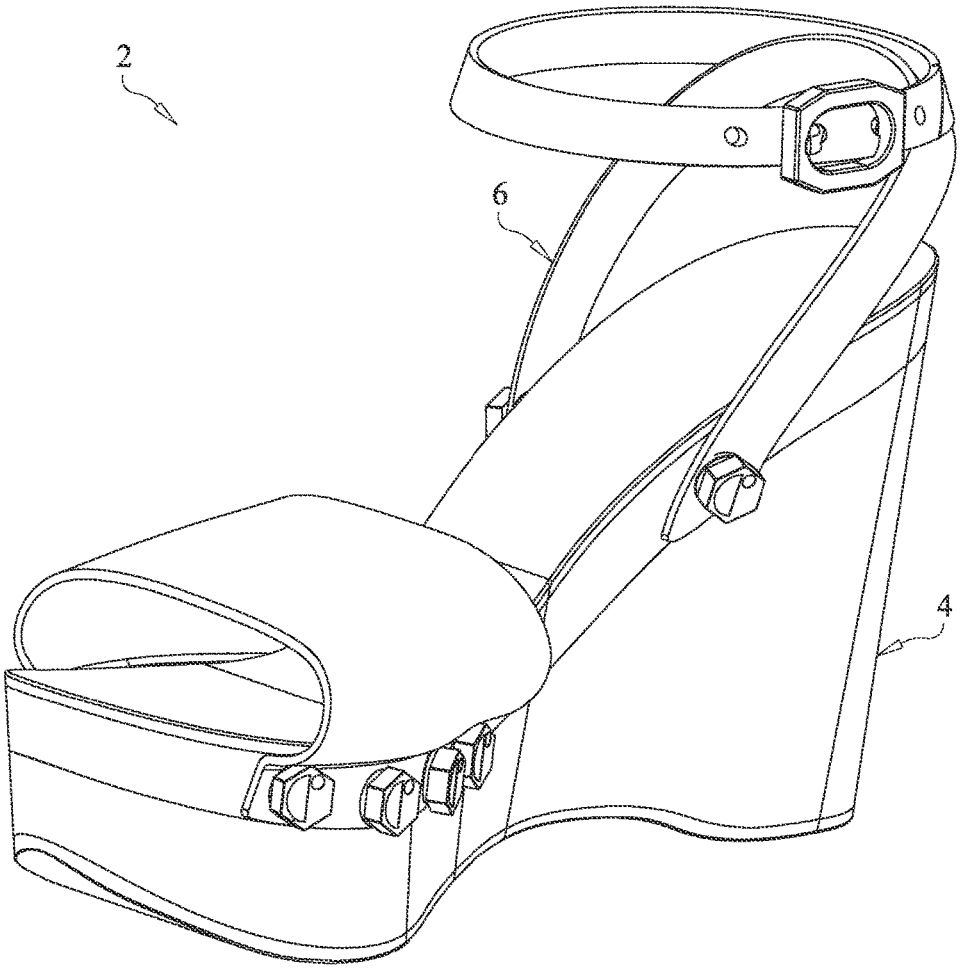
FIG. 1 is a front perspective view of one embodiment of a shoe assembly according to an example embodiment of the present disclosure.
Figure 2:
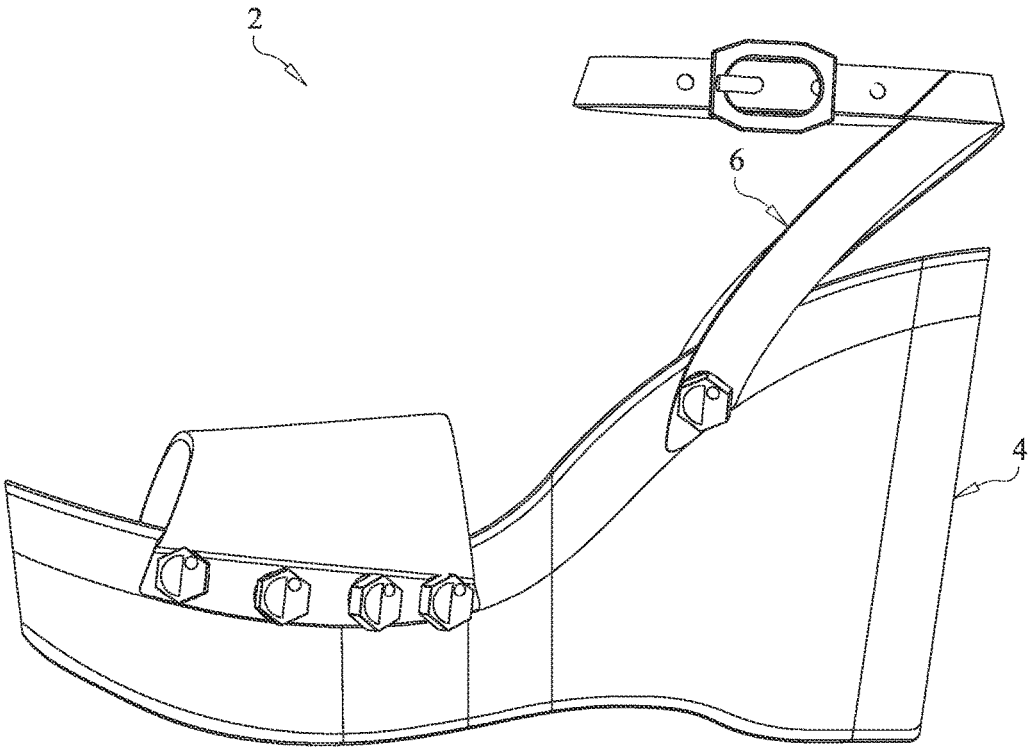
FIG. 2 is a side elevational view of the shoe assembly of FIG. 1.
Figure 3:
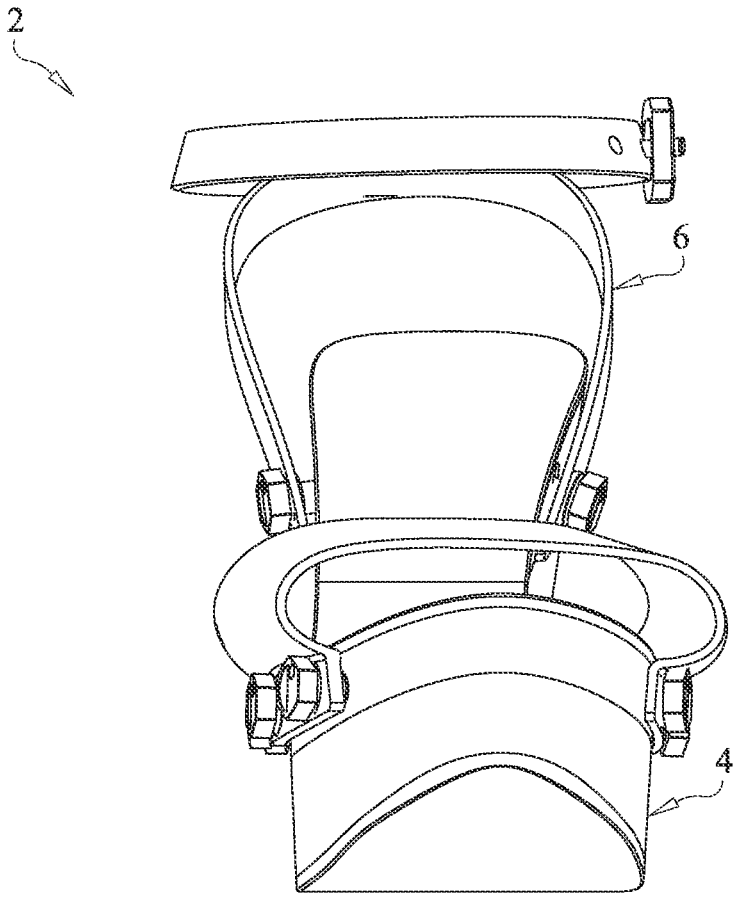
FIG. 3 is a front elevational view of the shoe assembly of FIG. 1.

FIGS. 1 to 3 illustrate the basic design and construction of one embodiment of a shoe assembly 2, according to an example embodiment of the present disclosure. Shoe assembly 2 includes a lower assembly 4 and an upper assembly 6. Lower assembly 4 is the portion of shoe assembly 2 that is located underneath and supports the weight of a person's foot. Upper assembly 6 is the portion of shoe assembly 2 which is located on top of a person's foot and holds the lower assembly 4 to the person's foot. As described in more detail below, upper assembly 6 is interchangeable with various embodiments of lower assemblies 4. Likewise, lower assembly 4 is interchangeable with various embodiments of upper assemblies 6. The interchangeability of various lower assemblies 4 and upper assemblies 6 allows a person to mix and match selected lower assemblies and selected upper assemblies so as to combine a selected lower assembly 4 and a selected upper assembly 6 that best compliments the person's outfit or occasion.

Figure 4:
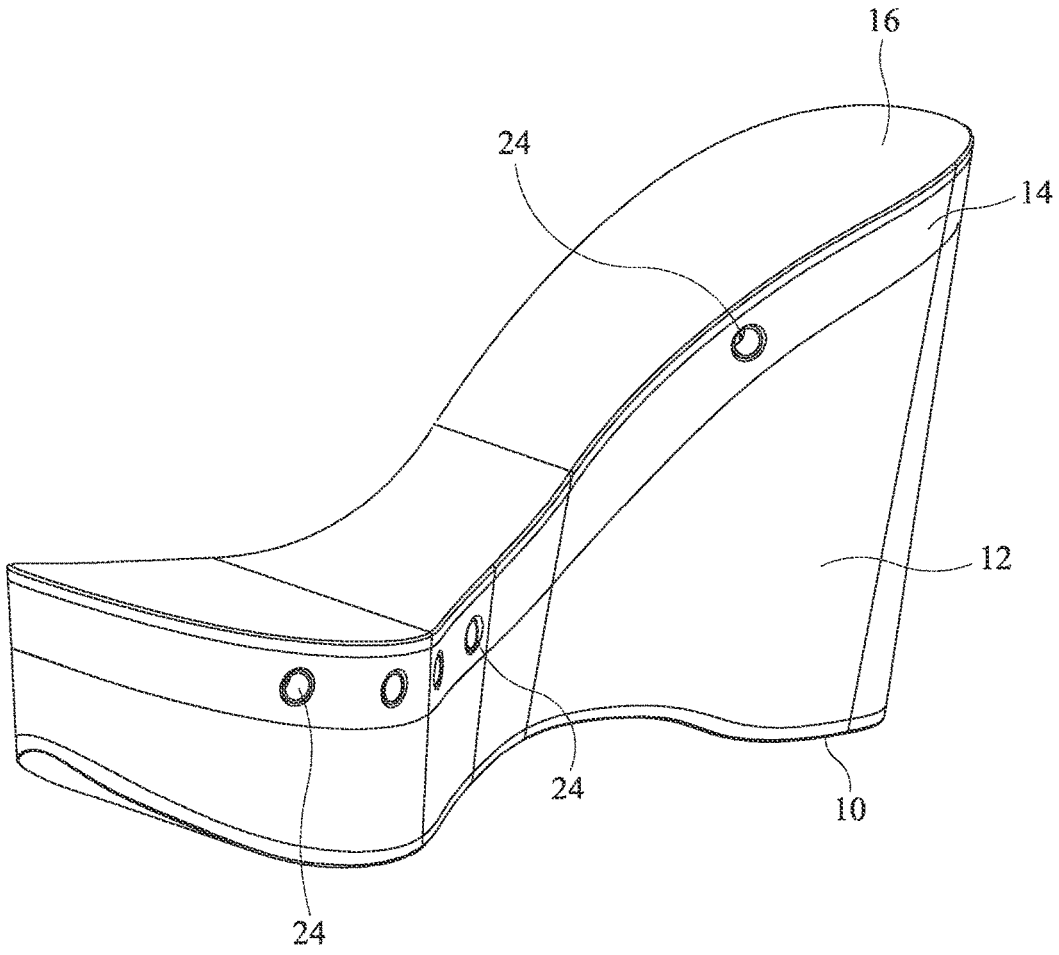
FIG. 4 is a front perspective view of the lower assembly of the shoe assembly of FIG. 1 without an upper assembly attached.
Figure 5:
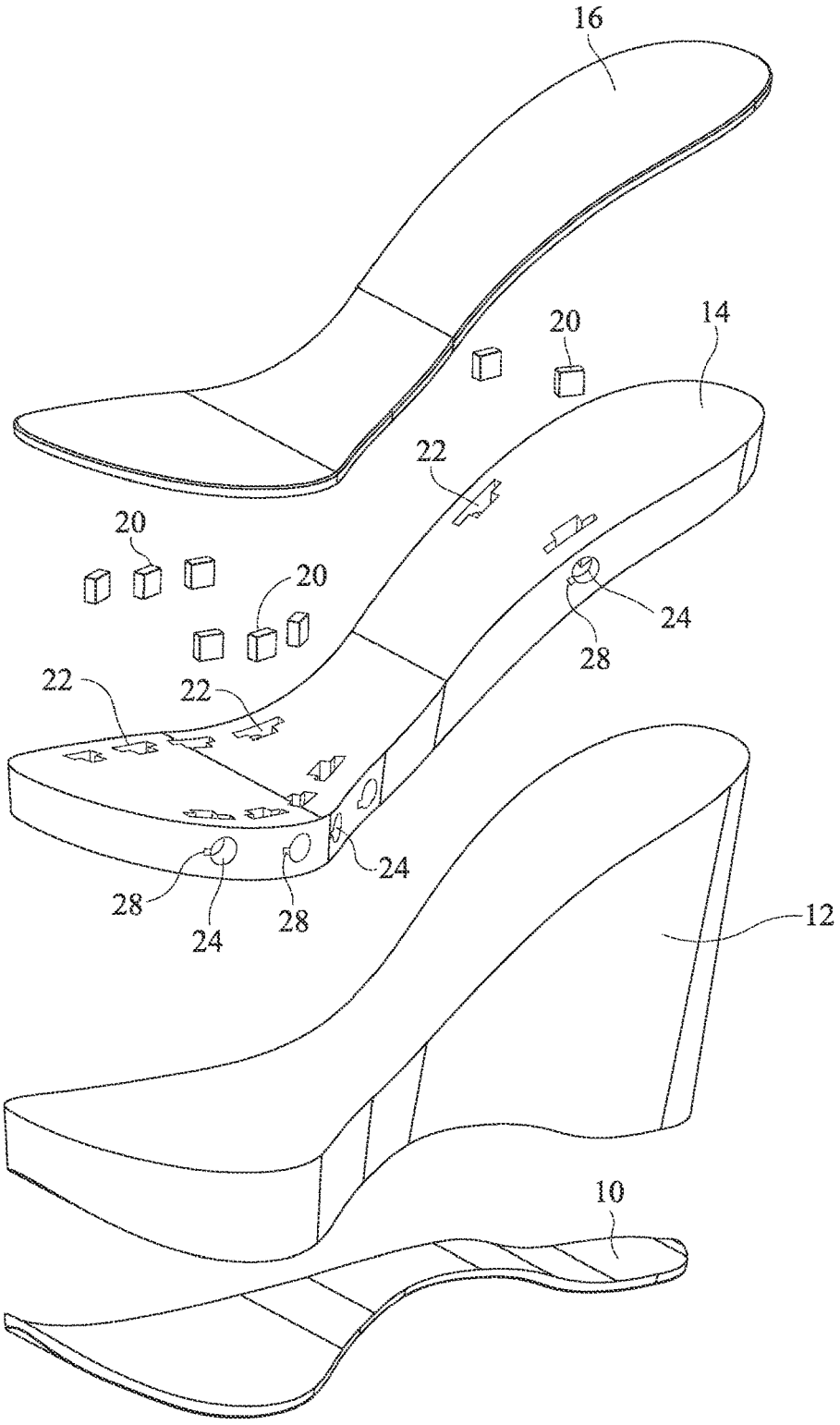
FIG. 5 is an exploded view of the lower assembly of FIG. 4.

FIGS. 4 and 5 show the lower assembly 4 of FIGS. 1 to 3 without upper assembly 6 attached. As illustrated, lower assembly 4 includes an outer sole layer 10, a lower layer 12, a mid-sole layer 14 and a sock layer 16. Those of ordinary skill in the art will recognize that a lower assembly 4 according to the present disclosure can have more or less layers than shown in FIGS. 4 and 5. That is, the separate layers shown in FIGS. 4 and 5 can be combined into fewer layers, or can be separated into additional layers. For convenience, the outer sole layer 10, lower layer 12, mid-sole layer 14 and sock layer 16 are shown as separate layers in the figures.

Outer sole layer 10 is the portion of lower assembly 4 that contacts the ground when worn by a person. Outer sole layer 10 can be made from a variety of materials, for example, rubber, leather, wood, raffia, polyurethane, polyvinyl chloride, plastic, thermoplastic or a combination thereof. Those of ordinary skill in the art will recognize other suitable materials. Ordinarily, an outer sole layer 10 is customized based on the look and feel of the shoe and the terrain that will typically be traveled by the shoe. For example, a hiking shoe may have a tougher outer sole layer 10 than a formal shoe. The present disclosure is advantageous in that different types of lower assemblies 4 with different types of outer sole layers 10 can be mixed and matched with different types of upper assemblies 6 to provide the proper shoe assembly 2 for any occasion. Outer sole layer 10 can also include a customized logo or design.

Lower layer 12 is the central portion of lower assembly 4 which generally supports the weight of the person wearing the shoe and attaches to outer sole layer 10 and mid-sole layer 14. The lower layer 12 can also serve the purpose of shock absorption as the shoe is worn by a person. Lower layer 12 can be made from a variety of materials, for example, rubber, leather, wood, raffia, polyurethane, polyvinyl chloride, plastic, thermoplastic, resin or a combination thereof. Those of ordinary skill in the art will recognize other suitable materials. Lower layer 12 can be attached to outer sole layer 10 and mid-sole layer 14 in a variety of ways, for example, by an adhesive such as glue or rubber cement, by welding, by sewing, by a mechanical attachment mechanism such as screws or clamps, or by any other suitable attachment means. Lower layer 12 may also be integrally formed with one or both of outer sole layer 10 and/or mid-sole layer 14. It is also contemplated that a lower assembly 4 may not include a lower layer 12 at all, that is, outer sole layer 10 and mid-sole layer 14 can be attached directly to each other to achieve a more compact shoe lower assembly 4. As discussed in more detail below, lower layer 12 can vary in size and shape for different lower assemblies 4 so that different lower assemblies 4 can be interchanged with different upper assemblies 6. For example, lower layer 12 could be altered in size and shape to form shoe assemblies 2 that are wedges, mid-range heels or high heels. Those of ordinary skill in the art will recognize other ways to modify lower layer 12 to provide various types and styles of shoes.

Figure 6:
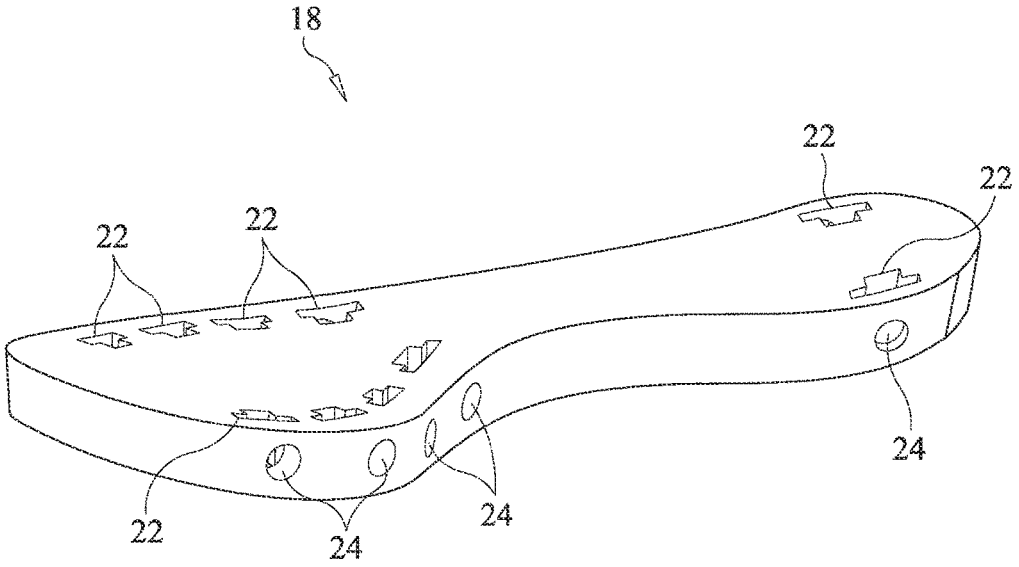
FIG. 6 is a front perspective view of an alternative embodiment of a lower assembly according to an example embodiment of the present disclosure

Mid-sole layer 14 is the portion of lower assembly 4 which provides the interchangeability of lower assembly 4 with various embodiments of upper assembly 6. Referring to FIG. 5, mid-sole layer 14 includes one or more fasteners 20, which magnetically attach mid-sole layer 14 to a shoe upper assembly 6, as described in more detail below. In the embodiment of FIG. 5, the fasteners 20 are magnets that magnetically attach to ferromagnetic fasteners 34 of upper assembly 6. As used herein, "magnetically attach" does not mean that the fasteners 20 must physically contact the fasteners 34. Those of ordinary skill will understand that magnetic attachment can also take place with intermediate parts or materials separating the fasteners 20 and the fasteners 34. Those of ordinary skill will also understand that the opposite configuration of FIG. 5 is also possible. That is, the fasteners 20 of lower assembly 4 can simply include a ferromagnetic material, and the fasteners 34 of upper assembly 6 can include the magnets. In the embodiment shown in FIG. 5, the fasteners 20 are located inside of lower assembly 4 by being fitted into a plurality of slots 22 in mid-sole layer 14 that are each aligned with a plurality of clearance apertures 24 in mid-sole layer 14. Alternatively, the fasteners 20 could be integrally formed as part of mid-sole layer 14, could be located on an outer surface of mid-sole layer 14, or top sole layer 16 could itself be made in part or in full of a magnetic material. Mid-sole layer 14 can be made from a variety of materials, for example, rubber, leather, wood, raffia, polyurethane, polyvinyl chloride, plastic, thermoplastic, resin or a combination thereof. Those of ordinary skill in the art will recognize other suitable materials. Mid-sole layer 14 can be attached to lower layer 12 and sock layer 16 in a variety of ways, for example, by an adhesive such as glue or rubber cement, by welding, by sewing, by a mechanical attachment mechanism such as screws or clamps, or by any other suitable attachment means. Mid-sole layer 14 can also be integrally formed with one or both of lower layer 12 and/or sock layer 16. It is also contemplated that a lower assembly 4 can be made with only mid-sole layer 14, as mid-sole layer 14 is the only layer necessary for the advantageous interchangeability provided by the present disclosure. FIG. 6 shows a lower assembly 18 including only a mid-sole layer 14 that includes a plurality of clearance apertures 24 for receiving fasteners 34 and a plurality of slots 22 for receiving fasteners 20. Upper assembly 6 can be removably attached to lower assembly 18 by sliding fasteners 34 into the clearance apertures 24 so that the fasteners 34 can magnetically attach to fasteners 20 inserted into the slots 22. Alternatively, the fasteners 20 can be integrally formed with mid-sole layer 14 so that there is no need for slots 22 that are visible from an outer surface of the lower assembly.

Sock layer 16 is the portion of lower assembly 4 which contacts and provides a comfortable surface for a person's foot. Sock layer 16 can be used to add extra cushioning to lower assembly 4, can be used to control the shape, moisture or smell of lower assembly 4, and/or can be used to conform to a user's natural foot shape or the positioning of the foot. Sock layer 16 can be made from a variety of materials, for example, rubber, leather, wood, raffia, woven or nonwoven textiles, polyurethane, polyvinyl chloride, plastic such as acrylonitrile butadiene styrene, thermoplastic, synthetic non-woven insole board or a combination thereof. Those of ordinary skill in the art will recognize other suitable materials. Sock layer 16 can be attached to mid-sole layer 14 in a variety of ways, for example, by an adhesive such as glue or rubber cement, by welding, by sewing, by a mechanical attachment mechanism such as screws or clamps, or by any other suitable attachment means. Sock layer 16 may also be integrally formed with mid-sole layer 14. As set forth above, a sock layer 16 can be customized for comfort, shape, moisture or smell, among other things. The present disclosure is advantageous in that different types of lower assemblies 4 with different types of sock layers 16 can be mixed and matched with different types of upper assemblies 6 to provide the proper shoe assembly 2 for any outfit or occasion.

Figure 8:
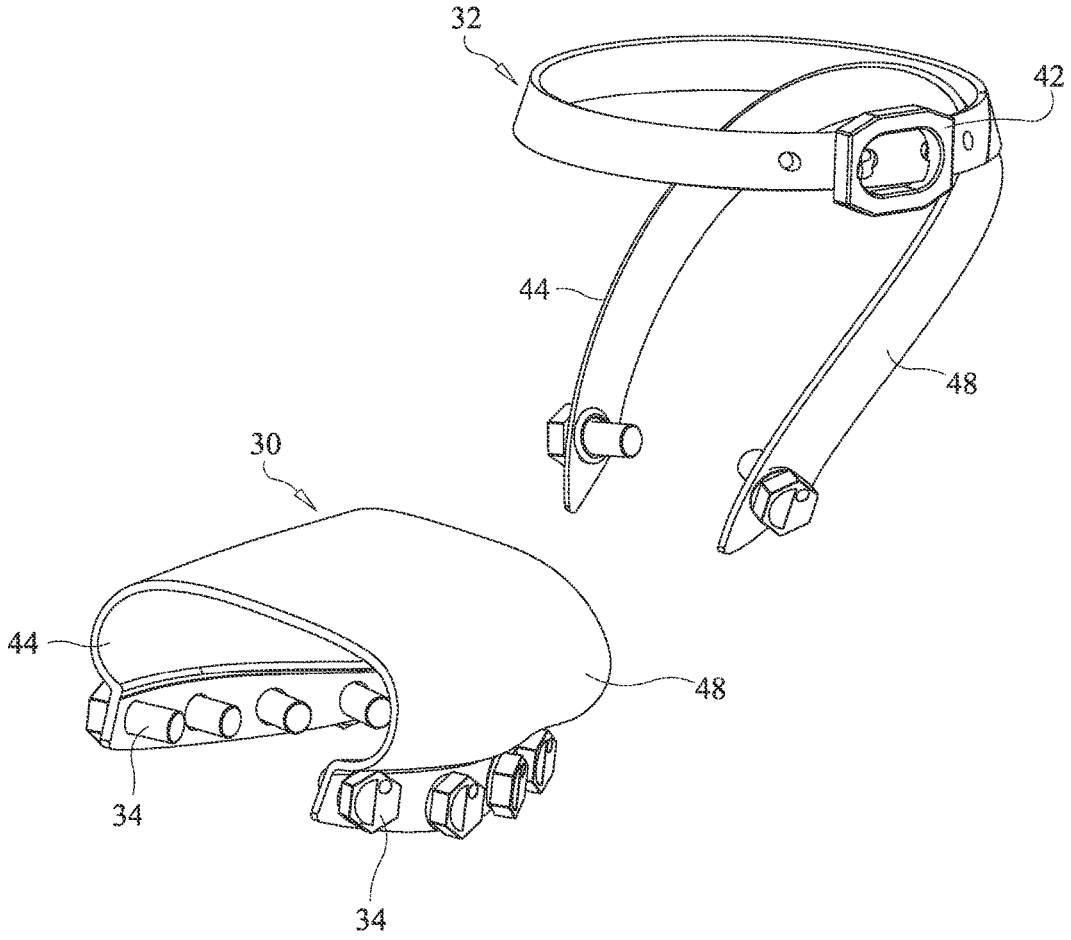
FIG. 8 is a front perspective view of the upper assembly of the shoe assembly of FIG. 1 without a lower assembly attached.
Figure 9:
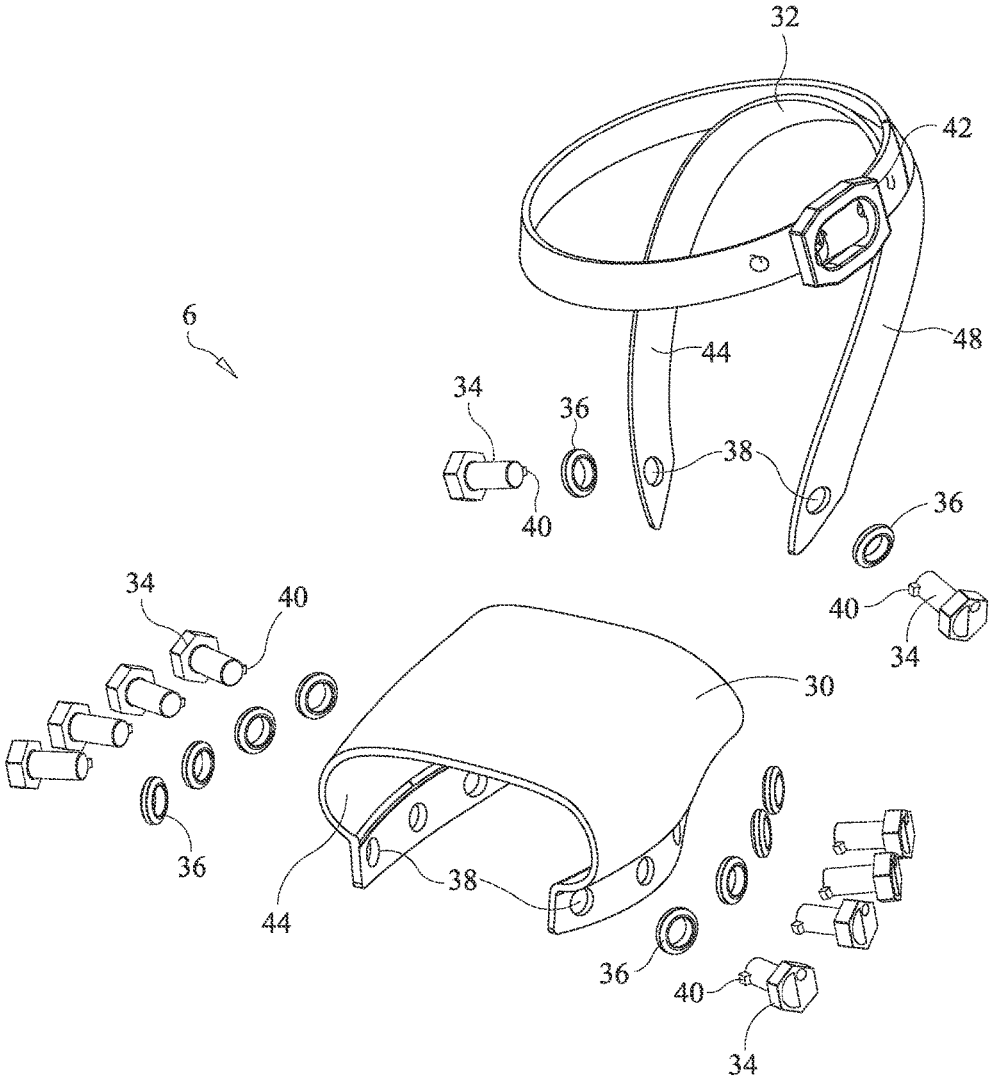
FIG. 9 is an exploded view of the upper assembly of FIG. 8.

FIGS. 8 and 9 show the upper assembly 6 of FIGS. 1 to 3 without the lower assembly 4 attached. Upper assembly 6 includes a toe strap 30 and an ankle strap 32. Toe strap 30 and ankle strap 32 can be formed as separate straps that separately removably attach to lower assembly 4, as shown in FIGS. 8 and 9. Toe strap 30 and ankle strap 32 can also be formed as a single piece which removably attaches to lower assembly 4. Alternatively, any number of straps 30, 32 can removably attach to lower assembly 4. For example, it is contemplated that three or more separate straps 30, 32 could be removably and/or adjustably attached to lower assembly 4. An upper assembly 6 could also be made with a toe strap 30 and not an ankle strap 32, or with an ankle strap 32 and not a toe strap 30. Upper assembly 6 can be made from a variety of materials, for example, rubber, leather, raffia, plastic, thermoplastic, fabric, chain-mail, feathers or other decorative items or a combination thereof. Those of ordinary skill in the art will recognize other suitable materials.

Upper assembly 6 includes one or more fasteners 34 and eyelets 36 to removably and/or adjustably attach toe strap 30 and ankle strap 32 to lower assembly 4. Preferably, the fasteners 34 are pins that include a material capable of being magnetically attracted to the magnetic force of a magnet. More preferably, the fasteners are quarter-inch pins. The pins can be any device capable of being inserted into clearance apertures 24 in mid-sole layer 14 of lower assembly 4, for example, screws, bolts, rivets, nails, beads or any other device capable of being inserted into a clearance aperture and including a material capable of being magnetically attracted to a magnet. Alternatively, the pins can include a magnet that is magnetically attracted to a ferromagnetic material of the one or more fasteners 20 of mid-sole layer 14.

Figure 24:
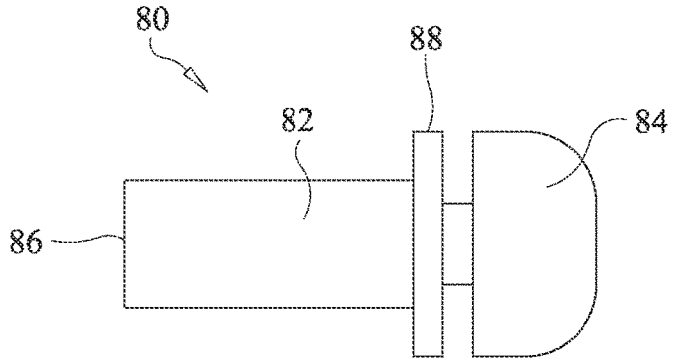
FIG. 24 is a side view of a fastener according to an example embodiment of the present disclosure.

One embodiment of a fastener 34 is shown in FIG. 24. In FIG. 24, fastener 80 includes a T-shaped body portion 82 and a head portion 84. In an embodiment, body portion 82 has a length of about 11 mm and a diameter of about 4.5 mm at a first end 86 that is configured to slide into a clearance aperture 24, and a length of about 1 mm and a diameter of about 9 mm at a second end 88 that is configured to abut an outer surface of lower portion 4 or upper portion 6 of shoe assembly 2. In an embodiment, head portion 84 can removably attach to body portion 82, for example by screw threads, to provide for different colors and styles of head portions 84 to be attached to body portion 82. In the embodiment shown, head portion 84 has a diameter of about 9 mm to match the second end 88 of body portion 82.

Figure 7:
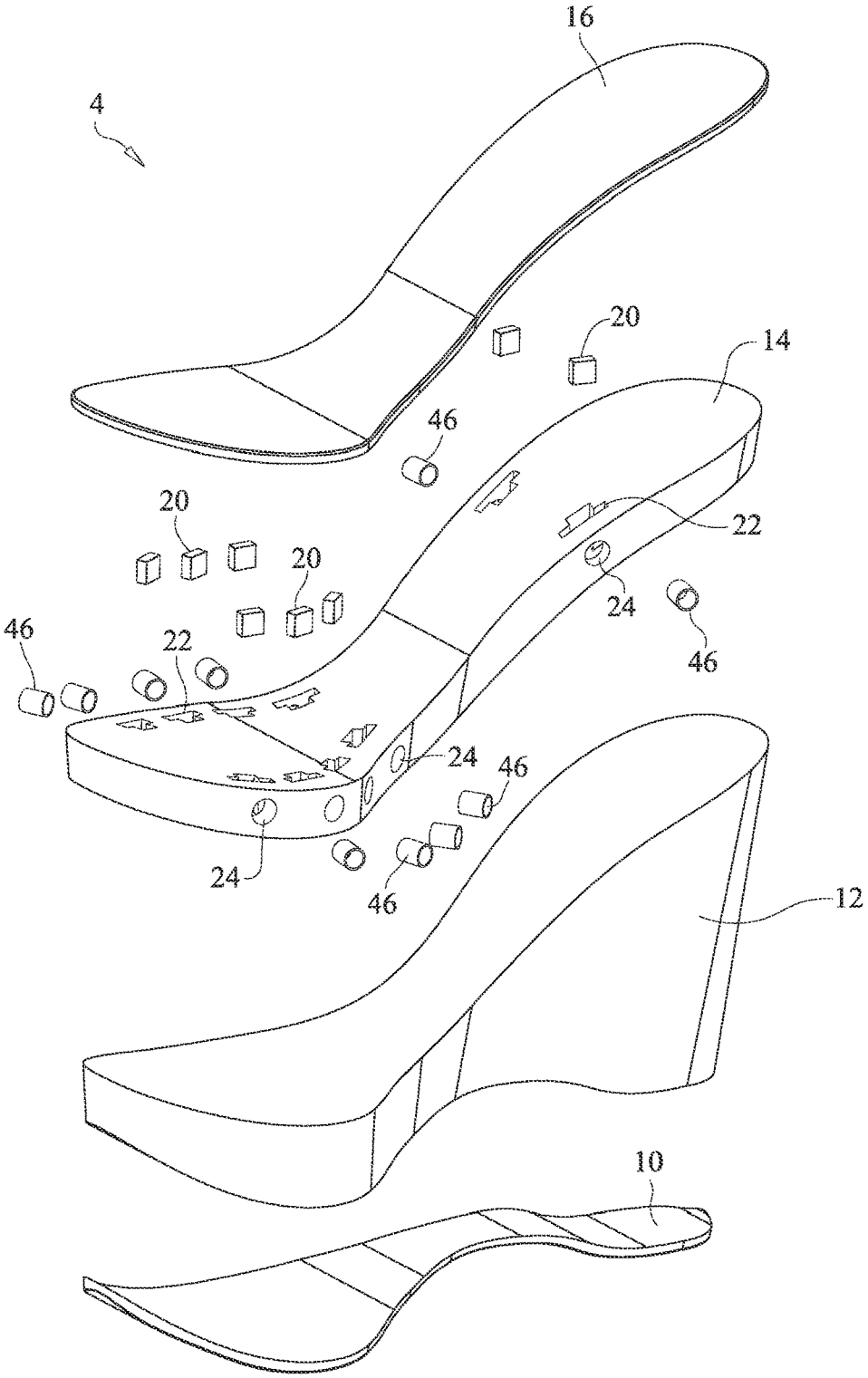
FIG. 7 is a front perspective view of an alternative embodiment of a lower assembly according to an example embodiment of the present disclosure.

Referring again to FIG. 5, mid-sole layer 14 of lower assembly 4 includes a plurality of clearance apertures 24 that are aligned with the plurality of fasteners 20, here magnets, positioned inside of the plurality of slots 22 in mid-sole layer 14. The plurality of fasteners 34 of upper assembly 6 can be inserted through eyelets 36 and apertures 38 in toe strap 30 and ankle strap 32 and then inserted into the clearance apertures 24 of mid-sole layer 14. The fasteners 34 include a ferromagnetic material and can be held within mid-sole layer 14 by the magnetic force provided by the fasteners 20 that are aligned with each of the clearance apertures 24. As will be recognized by those of ordinary skill in the art, the pulling force provided by each of the fasteners 20 must be strong enough to hold the fasteners 34 against mid-sole layer 14 while the shoe is being worn. Those of ordinary skill will understand that the opposite configuration is also possible. That is, the fasteners 20 of lower assembly 4 can simply include a ferromagnetic material, and the fasteners 34 of upper assembly can include the magnets. Alternatively, fasteners 20 and fasteners 34 can both include magnets with opposite pulling forces to magnetically attract the fasteners 20, 34 to each other. Such a configuration is advantageous in that it provides an increased force over the single magnet configuration. Sleeves 46 can also be fitted inside of the clearance holes 24 of the lower assembly 4 to allow the pins to be more smoothly inserted into the clearance apertures 24, as shown in FIG. 7. In one embodiment, the sleeves are metal. In an embodiment, each sleeve is about 10.75 mm long, has an inner radius of about 5 mm, and has an outer radius of about 6 mm.

The magnets of fasteners 20 and/or fasteners 34 are preferably rare earth magnets, for example, N50 or N52 grade magnets. In an example embodiment, the magnets, for example, can be 0.25×0.25×0.125 inches and be made of Grade N50 NdFeB material with NiCuNi coating. The magnets can also be coated with rubber or other types of coating such as urethane to resist corrosion over time. Those of ordinary skill in the art will understand that the size, type and coating of the magnets will differ depending on the types of lower assemblies and upper assemblies and the types of fasteners used to removably attach the lower assemblies and upper assemblies.

Figure 23:
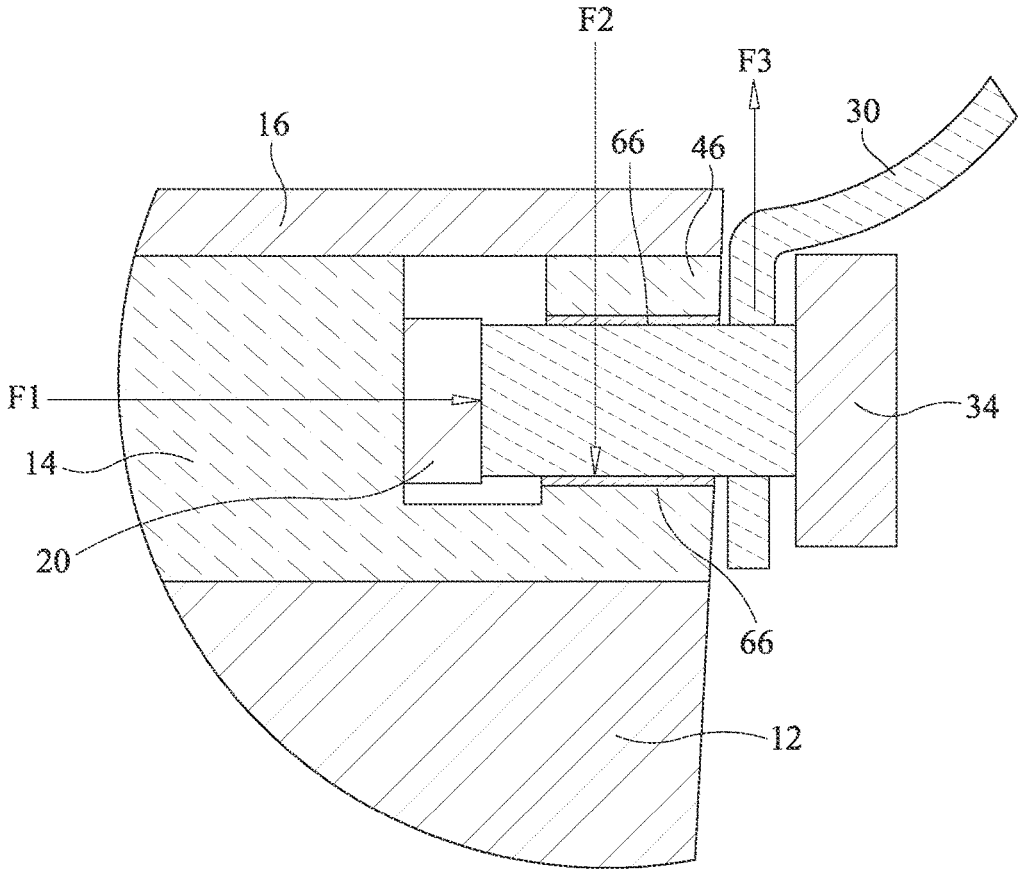
FIG. 23 is a cross sectional view showing the forces applied to a fastener according to an example embodiment of the present disclosure.

In addition to the magnetic force provided by the magnets of fasteners 20 and/or fasteners 34, the insertion of fasteners 34 into the clearance apertures 24 of mid-sole layer 14 also assists in holding upper assembly 6 in place with respect to lower assembly 4. That is, the fasteners 20, here magnets, provide a horizontal magnetic pulling force on the fasteners 34, here pins, and the clearance apertures 24 and/or sleeves 46 hold the pins in place when a vertical or perpendicular horizontal force is applied against the pins. Sliding the fasteners 34 into the lower assembly 4 through clearance apertures 24 and/or sleeves 46, and using magnets as fasteners 20 inside of lower assembly 4, can therefore firmly hold upper assembly 6 in place with respect to lower assembly 4. FIG. 23 illustrates a cross sectional view of a fastener 34 inserted into a clearance hole 24 and being magnetically attracted to a fastener 20, which here includes a magnet. As illustrated, the fastener 20 prevents the fastener 34 from being withdrawn from the clearance hole 24 along a horizontal force F1, and the sidewalls 66 of the clearance aperture 24 and/or the sleeve 46 hold the fastener 34 in place with respect to mid-sole layer 14 when a vertical force F2 or F3 is applied to the fastener 34.

Figure 11:
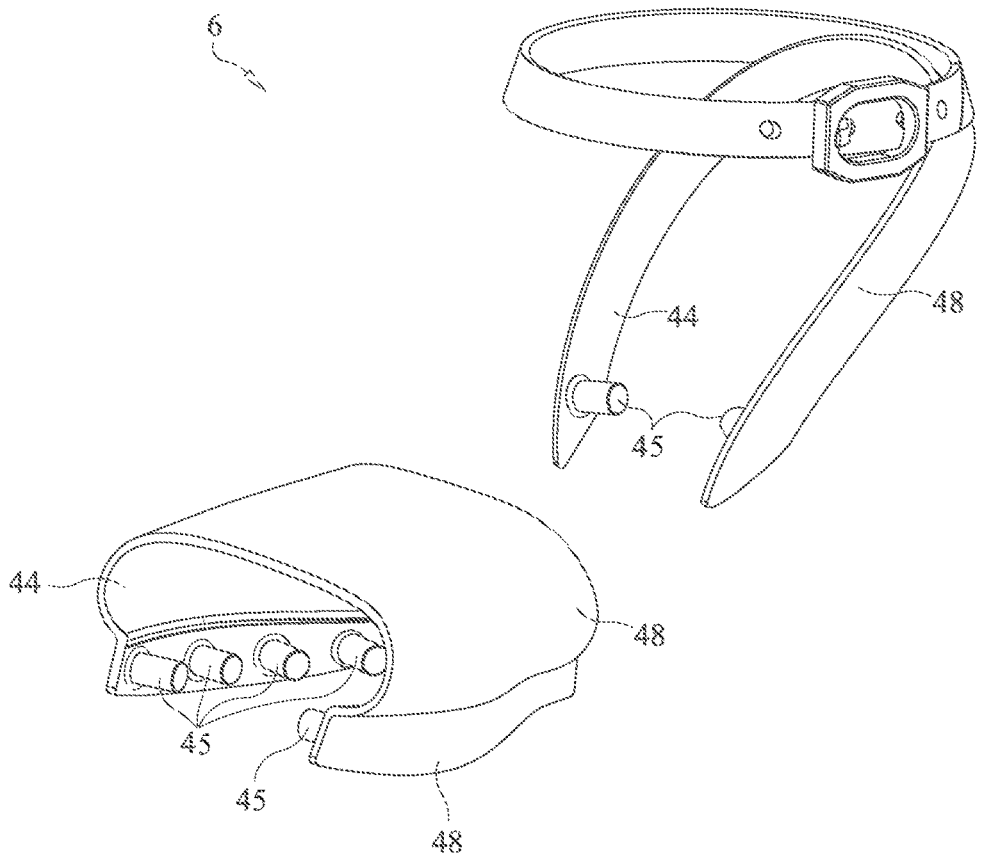
FIG. 11 is a front perspective view of an alternative embodiment of an upper assembly that can be removably attached to the lower assembly of FIG. 4.

In FIGS. 8 and 9, the fasteners 34 are shown to pass through apertures 38 in toe strap 30 and ankle strap 32. These views are shown to more easily illustrate how the fasteners 34 can attach the toe strap 30 and ankle strap 32 to the mid-sole layer 14 of lower assembly 4. This embodiment also allows a single set of one or more fasteners 34 to be used to attach various upper assemblies 6 to various lower assemblies 4. To improve the aesthetic appearance of shoe assembly 2, however, the fasteners can also attach to the inside surface 44 of toe strap 30 and/or ankle strap 32, or can be formed integrally with toe strap 30 and/or ankle strap 32. In this way, a person can avoid unsightly fasteners protruding from the outside of the shoe assembly 2. FIG. 11 shows an embodiment of an upper assembly 6 with fasteners 45 attached to the inner surface 44 of an upper assembly 6. The upper assembly 6 of FIG. 11 can be used with the lower assembly 4 of FIGS. 4 and 5 by simply sliding the fasteners 45 into the clearance apertures 24 of mid-sole layer 14 of lower assembly 4. As illustrated in FIG. 11, the fasteners 45 cannot be seen from the outside surface 48 of upper assembly 6.

In the embodiment shown in FIG. 9, the fasteners 34 include a twist and lock feature 40, which provides an extra attachment force in addition to the magnetic force provided by the fasteners 20 of mid-sole layer 14. In such an embodiment, the clearance apertures 24 include keyholes 28 (FIGS. 5 and 10), and the twist and lock feature 40 is inserted through the keyhole 28. Once inserted, the fastener 34 can be turned about a quarter rotation so that the twist and lock feature 40 cannot be withdrawn from the keyhole 28 unless the twist and lock feature 40 is turned back a quarter rotation so as to again align with the keyhole 28.

Figure 10:
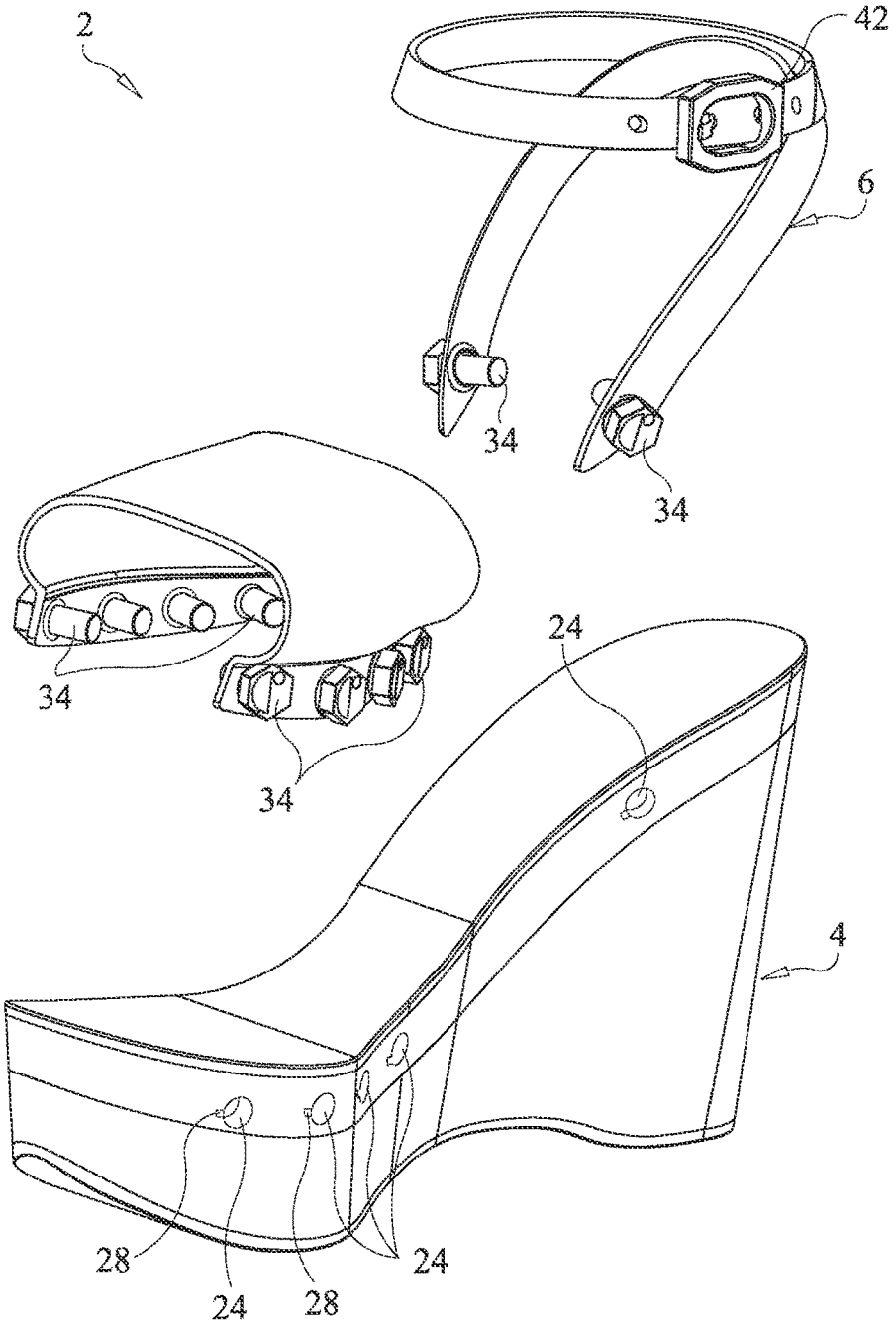
FIG. 10 is an exploded view of the lower assembly of FIG. 4 and the upper assembly of FIG. 8.

FIG. 10 shows an exploded view with both the lower assembly 4 of FIG. 4 and the upper assembly 6 of FIG. 8. As shown in FIG. 10, upper assembly 8 includes ten fasteners 34 that align with ten clearance apertures 24 (five shown) in mid-sole layer 14 of lower assembly 4. It is contemplated that additional or fewer fasteners or clearance apertures could be used to accomplish the same purpose. It is also contemplated that more clearance apertures 24 could be used than fasteners 34 so that a person could adjust upper assembly 6 along lower assembly 4 to most comfortably position upper assembly 6 with respect to the person's foot. A person could also attach toe strap 30 of upper assembly 6 to lower assembly 4 without attaching ankle strap 32, or vice versa. A person could also mix and match various toe straps 32 and ankle straps 34 of different styles and colors with the same or a different lower assembly 4. A person thus has various options for customizing a shoe assembly 2 according to the present disclosure in addition to interchanging various lower assemblies 4 and upper assemblies 6 with each other.

The shoe assembly 2 of FIGS. 1 to 10 includes an open-toed toe strap 30 and a single-strap ankle strap 32. A person puts on shoe assembly 2 by sliding their foot between toe strap 32 and sock layer 16 and by fastening a strap of ankle strap 32 around their ankle using buckle 42. It is contemplated, however, that other types of straps 30, 32 could be attached to lower assembly 4. For example, toe strap 30 could be a closed-toe strap with additional fasteners 34 attaching toe strap 30 to the front surface of mid-sole layer 14. Ankle strap 32 could also include multiple straps that attach to attachments layer 14 and/or toe strap 30 with one or more fasteners 34.

Figure 12:
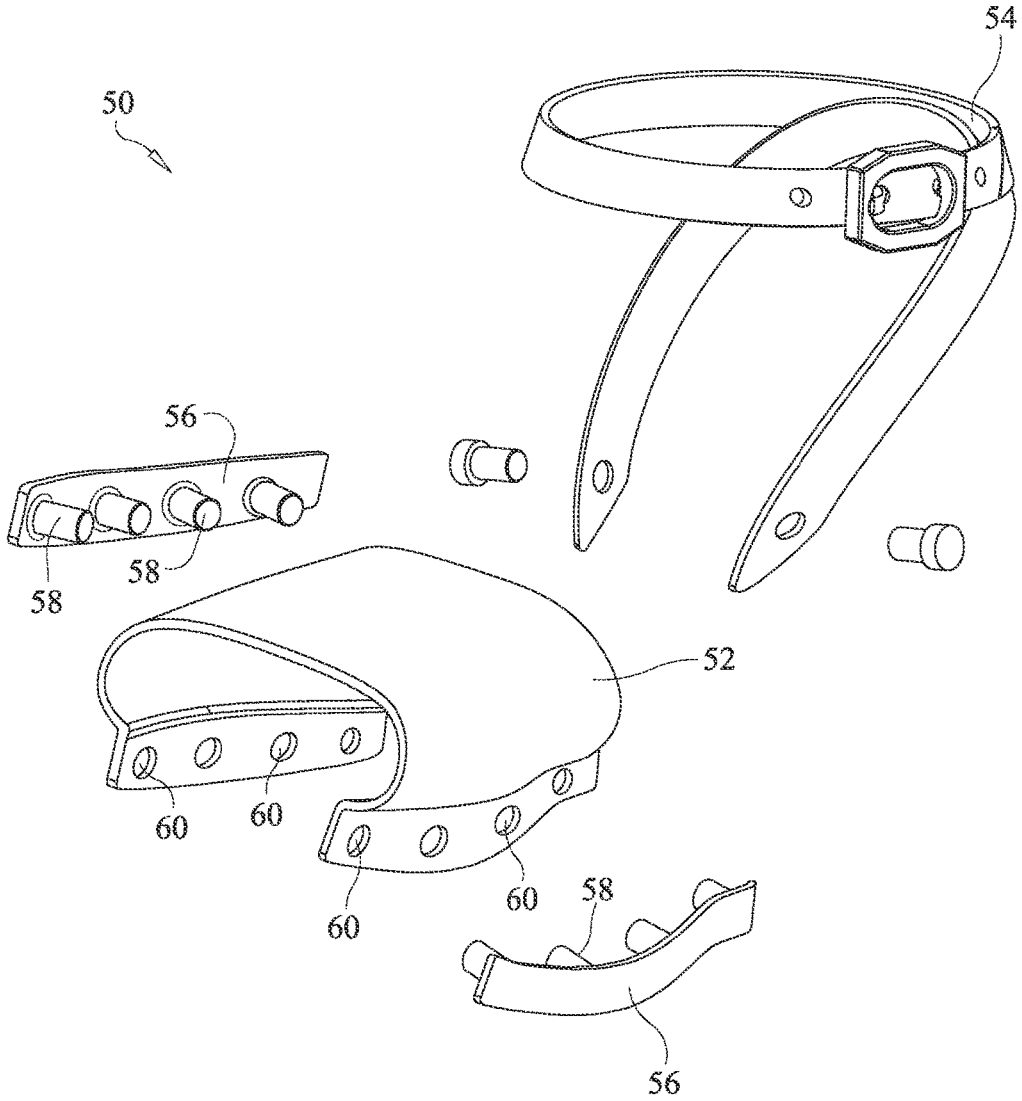
FIG. 12 is an exploded view of yet another alternative embodiment of an upper assembly that can be removably attached to the lower assembly of FIG. 4.

FIG. 12 shows an alternative embodiment of an upper assembly 50 that can be attached to lower assembly 4. Like upper assembly 6, upper assembly 50 includes a toe strap 52 and an ankle strap 54. Toe strap 52 can be attached to lower assembly 4 using a single fastener 56 on each side. Fastener 56 includes four protrusions 58 which slide through apertures 60 in toe strap 52 and into respective clearance apertures 24 in the mid-sole layer 14 of lower assembly 4. Fastener 56 can be advantageous over the separate fasteners 34 used to attach upper assembly 6 to lower assembly 4 because fastener 56 can attach toe strap 52 to mid-sole layer 14 with a single motion and because the outer surface of fastener 56 may be more aesthetically pleasing to the user than the separate fasteners protruding from toe strap 30 as shown in FIG. 1. To accommodate different colors and styles of lower assemblies 4 and upper assemblies 50, various fasteners 56 of different colors and styles can be used so that a user can choose the fastener that best matches their outfit or the lower assembly 4 or upper assembly 50 chosen to match their outfit.

Figure 13:
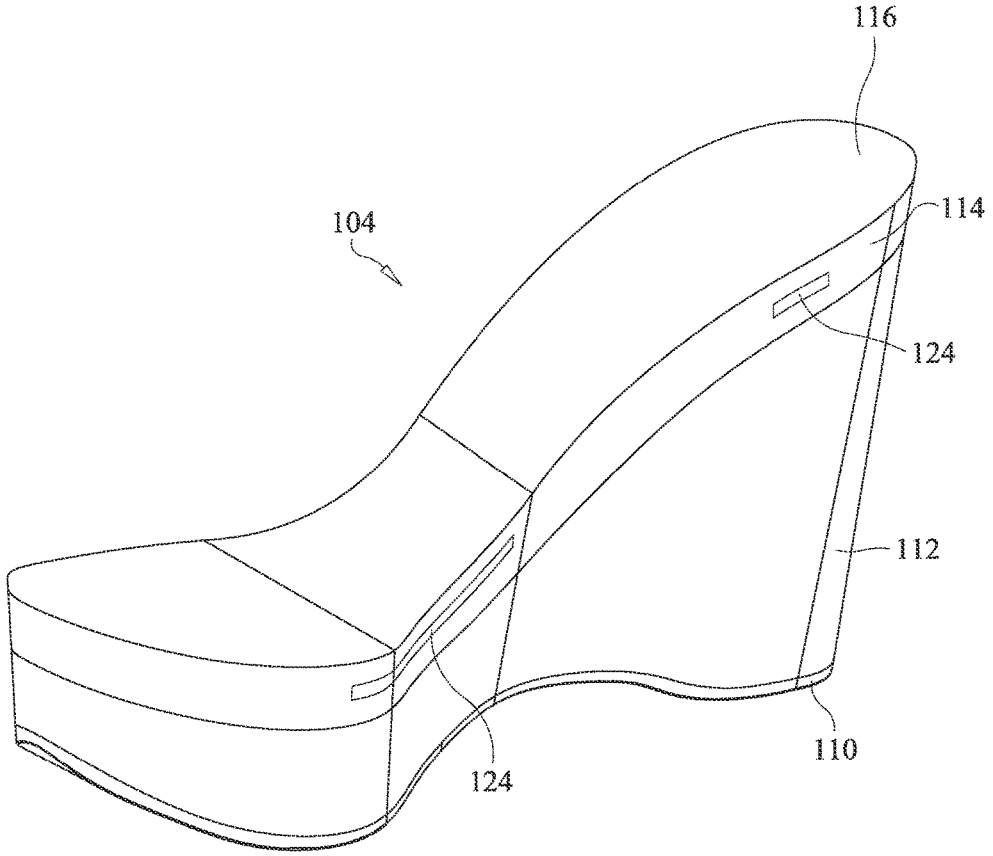
FIG. 13 is a front perspective view of yet another alternative embodiment of a lower assembly according to an example embodiment of the present disclosure.
Figure 14:
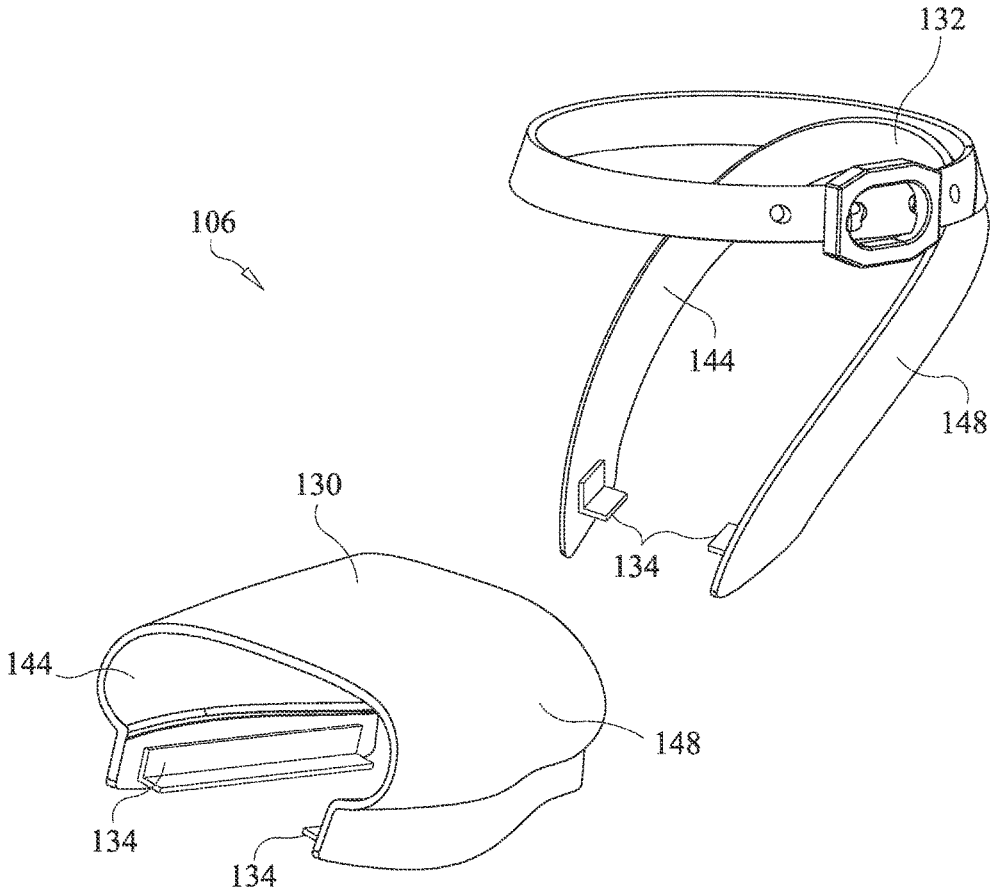
FIG. 14 is a front perspective view of an embodiment of an upper assembly that can be removably attached to the lower assembly of FIG. 13.
Figure 15:
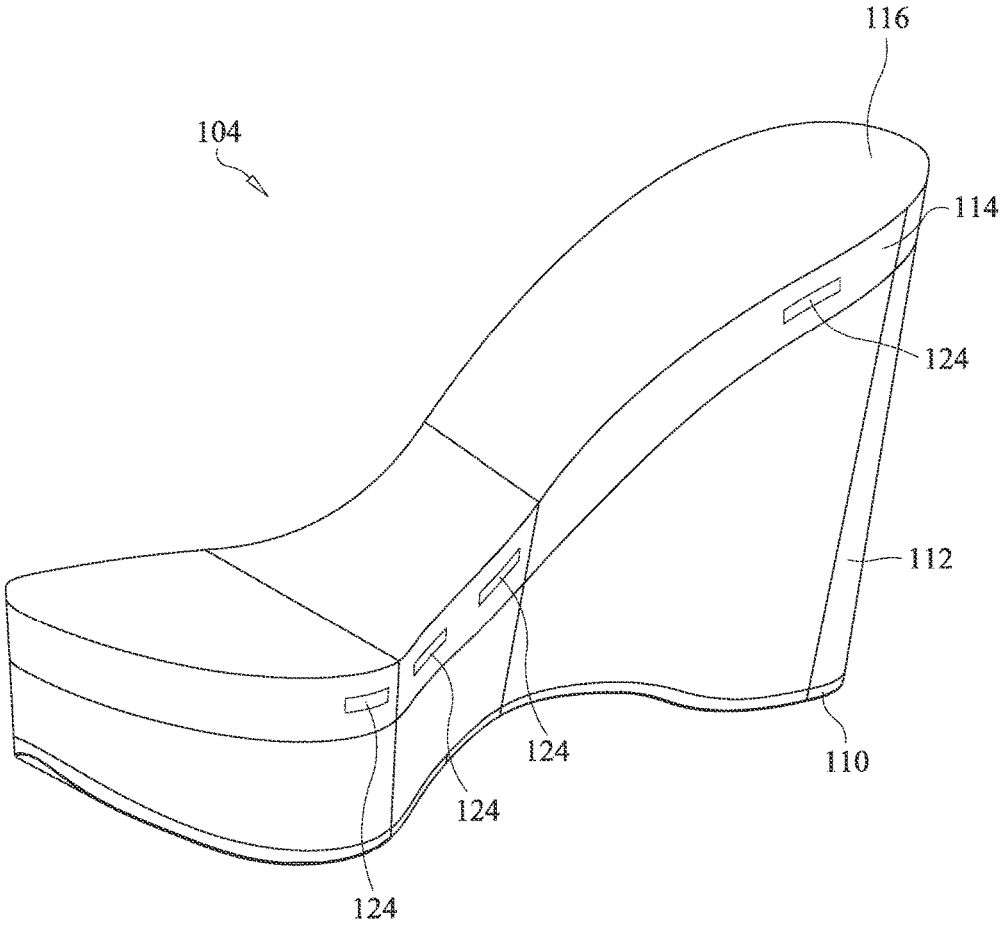
FIG. 15 is a front perspective view of yet another alternative embodiment of a lower assembly according to an example embodiment of the present disclosure.
Figure 16:
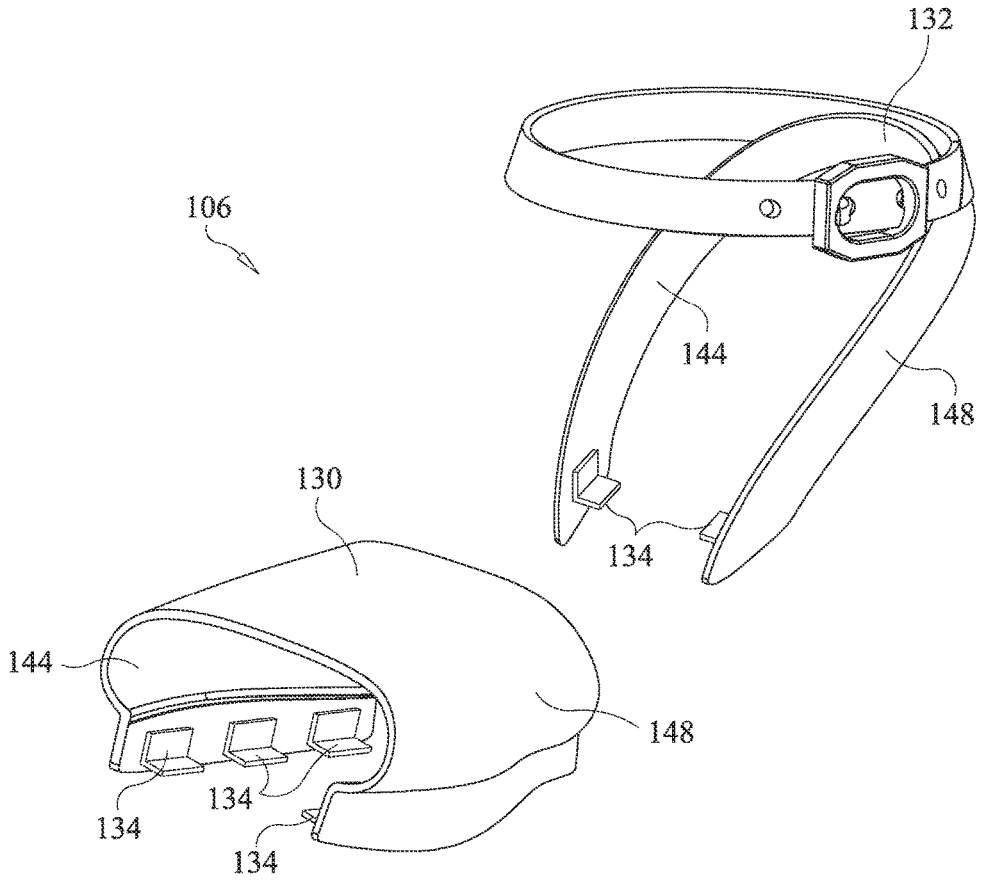
FIG. 16 is a front perspective view of an embodiment of an upper assembly that can be removably attached to the lower assembly of FIG. 15.

FIGS. 13 and 14 show an alternative embodiment of a shoe assembly 102 wherein the fasteners are L-shaped brackets 134 used to removably attach a lower assembly 104 to an upper assembly 106. Similar to the embodiments of FIGS. 1 to 10, lower assembly 104 includes an outer sole layer 110, a lower layer 112, an mid-sole layer 114 and a sock layer 116, and upper assembly 106 includes a toe strap 130 and an ankle strap 132. Each of these elements can be formed of the materials and attached together as described above with respect to FIGS. 1 to 10. Upper assembly 106 differs from upper assembly 6 in that the fasteners 134 are L-shaped brackets that slide into rectangular-shaped clearance apertures 124 on mid-sole layer 114 of lower assembly 104. FIG. 14 further shows that the fasteners 134 can attach to the inside surface 144 of toe strap 130 and/or ankle strap 132, or can be integrally formed with toe strap 130 and/or ankle strap 132, to avoid the fasteners 134 from being visible from the outside surface 148 of the upper assembly 106 of shoe assembly 102. The fasteners 134 can be attached to the inner surface 144 of upper assembly 106 by various methods, for example, by an adhesive, by welding, by sewing, by a mechanical attachment mechanism such as screws or clamps, or by any other suitable attachment means. Those of ordinary skill in the art will understand additional methods of attaching fasteners 134 to shoe upper assembly 106. Alternatively, the fasteners can be attached to the outside of upper assembly 106 and optionally decorated with a texture or color pattern. In the embodiment of FIGS. 13 and 14, the lower assembly 104 includes magnets and the fasteners 134 include a ferromagnetic material. Alternatively, the lower assembly 104 can include the ferromagnetic material and the fasteners 134 can include magnets. FIGS. 15 and 16 show an alternative embodiment in which the toe strap 130 includes a plurality of fasteners 134 that slide into a plurality of rectangular-shaped clearance apertures 124 on each side of mid-sole layer 114 of lower assembly 104. Those of ordinary skill in the art will understand that more or less L-shaped bracket fasteners 134 can be used to attach upper assembly 106 to lower assembly 104.

Figure 17:
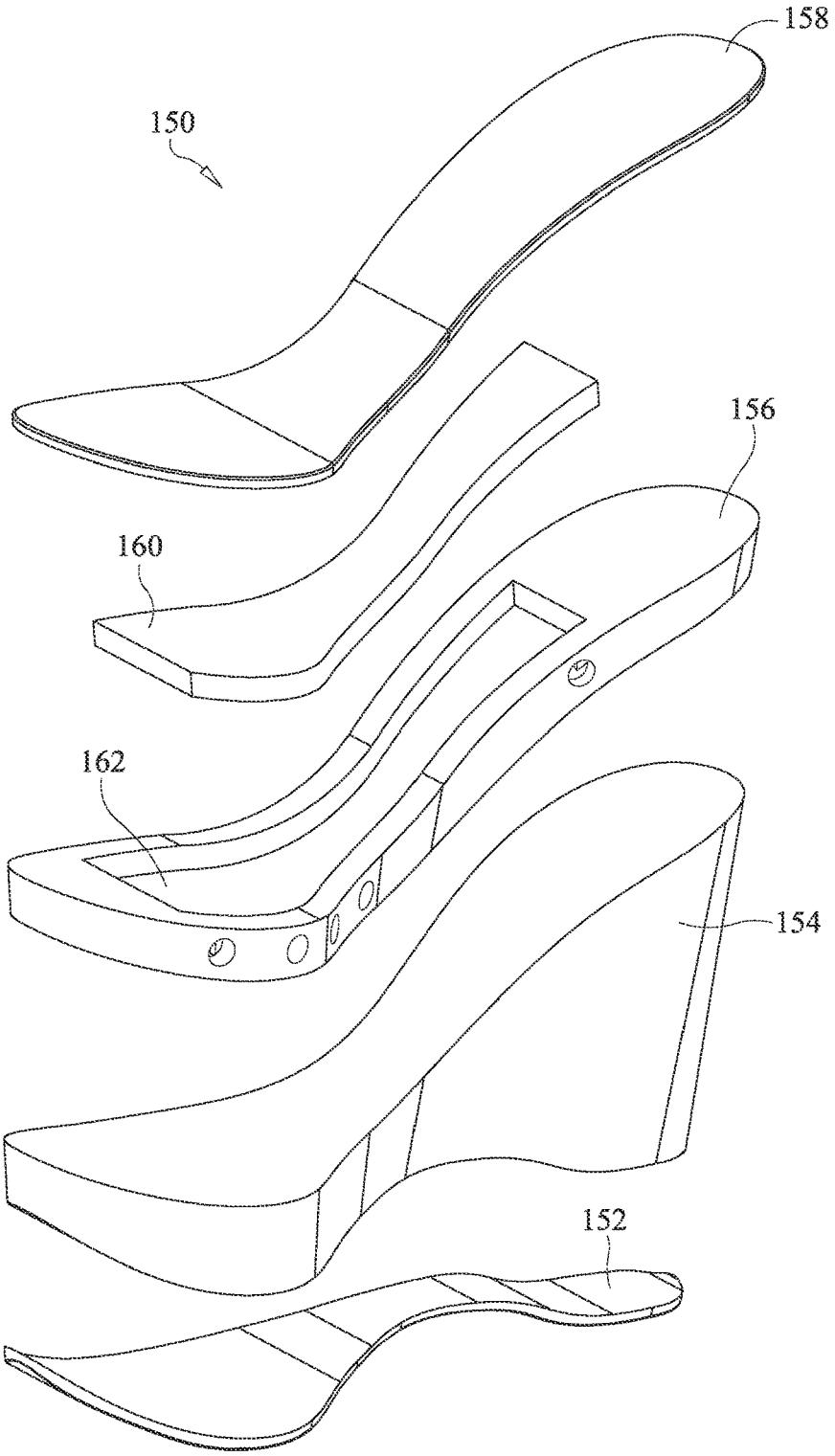
FIG. 17 is an exploded view of yet another alternative embodiment of a lower assembly according to an example embodiment of the present disclosure.

FIG. 17 shows another alternative embodiment of a lower assembly 150 including an outer sole layer 152, a lower layer 154, a mid-sole layer 156 and a sock layer 158. Instead of a plurality of slots to receive a plurality of magnets as with lower assembly 4, mid-sole layer 156 of lower assembly 150 includes a single aperture 162 to receive a single magnet 160. One or more fasteners of a corresponding upper assembly, such as upper assemblies 6 and 50 can then be magnetically and removably attached to lower assembly 150 using the magnetic force of magnet 160 as described above.

Figure 18:
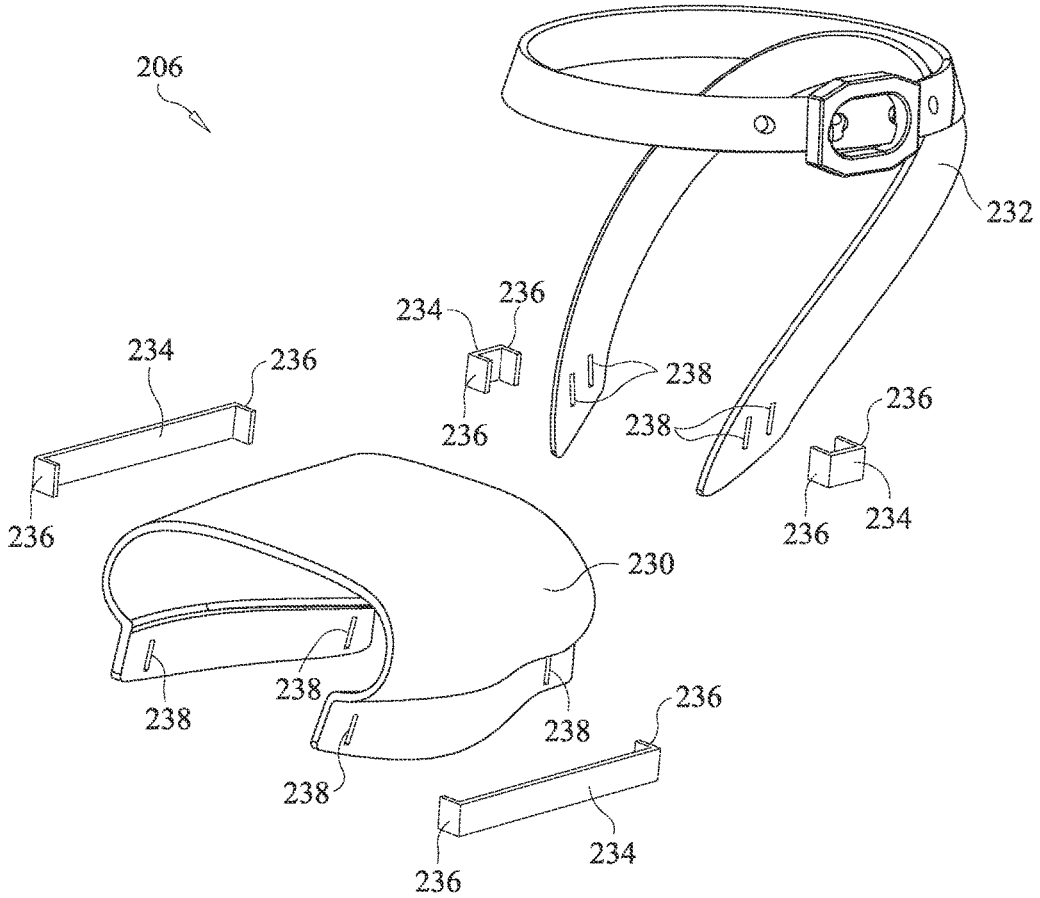
FIG. 18 is an exploded view of yet another alternative embodiment of an upper assembly according to an example embodiment of the present disclosure.
Figure 19:
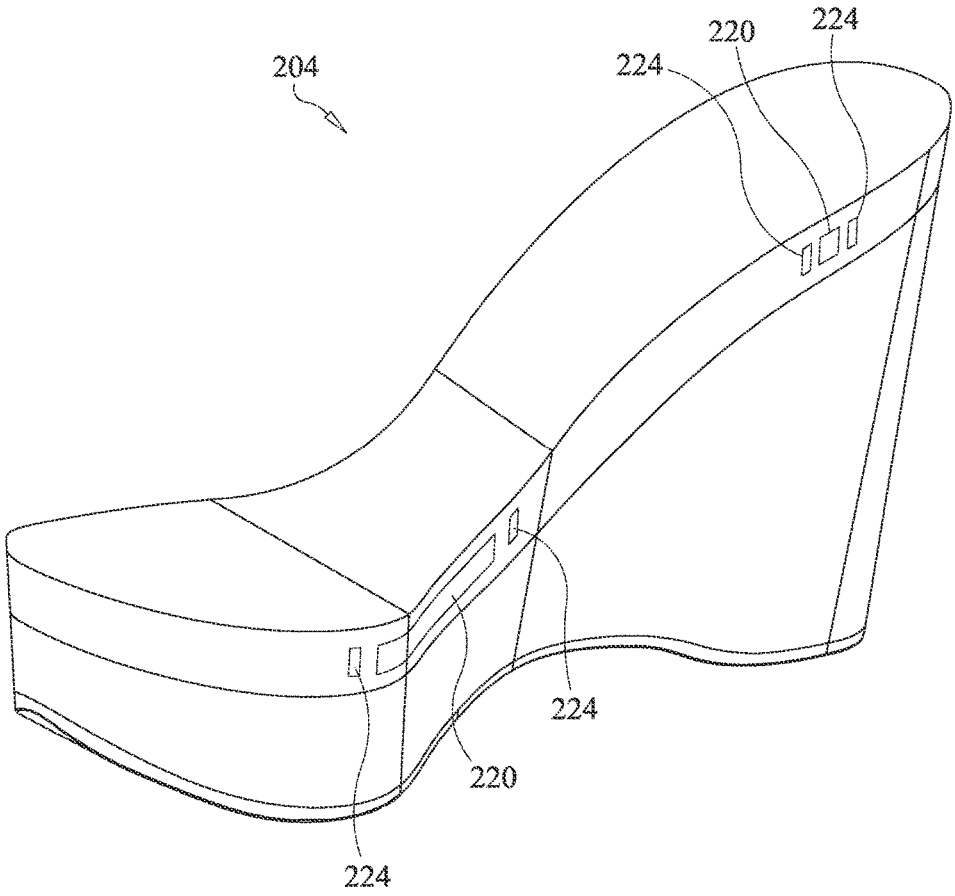
FIG. 19 is a front perspective view of an embodiment of a lower assembly that can be removably attached to the upper assembly of FIG. 18.

FIGS. 18 and 19 show an alternative embodiment of a shoe assembly 202. FIG. 18 shows an upper assembly 206 that includes one or more fasteners 234 that each include one or more protrusions 236. The fasteners 234 include a ferromagnetic material. FIG. 19 shows a lower assembly 204 that includes one or more magnets 220 located on an outer surface of the lower assembly and one or more clearance apertures 224 located around the magnets 220. In use, the protrusions 236 of the fasteners 234 pass through apertures 238 in the toe strap 230 and/or ankle strap 232 of the upper assembly 206 and then into the clearance apertures 224 of the lower assembly 206, and the ferromagnetic material of the fasteners 234 is magnetically attracted to the magnets 220 of the lower assembly 204. Similar to the embodiments described above, the magnets 220 provide a horizontal magnetic pulling force on the fasteners 234, and the clearance apertures 224 hold the protrusions 236 of the fasteners 234 in place when a vertical or perpendicular horizontal force is applied against the fasteners 234. Sliding the protrusions 236 of the fasteners 234 into the lower assembly 204 through clearance apertures 224, and using magnets 220 on the outer surface of lower assembly 204, can therefore firmly hold upper assembly 206 in place with respect to lower assembly 204. Alternatively, the magnets 220 can simply include a ferromagnetic material and the fasteners 236 can include magnets to provide the magnetically attractive force. The difference between this embodiment and the above embodiments is that the magnets or ferromagnetic material 220 is located on an outer surface of the lower assembly 204 instead of inside the lower assembly 204. The same goal, however, can be accomplished because the fasteners are being inserted into the lower assembly and at the same time are being magnetically attracted to the lower assembly.

Figure 20A:
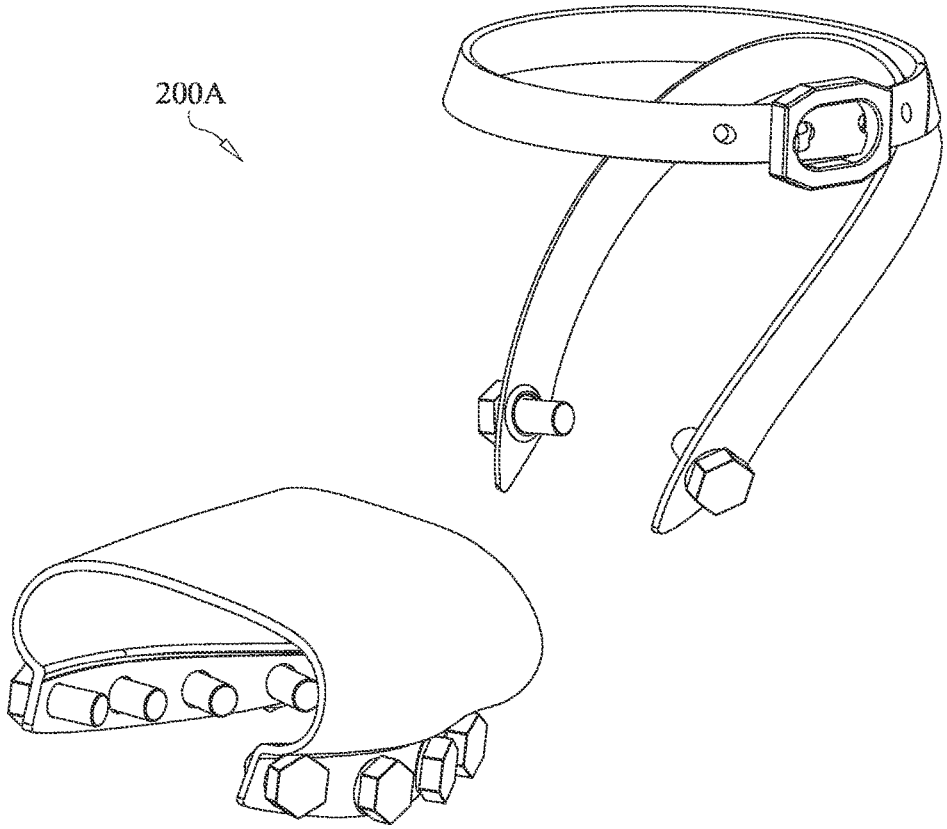
FIGS. 20*a* to 20*c* are front perspective views of three different upper assemblies according to an example embodiment of the present disclosure.
Figure 20B:
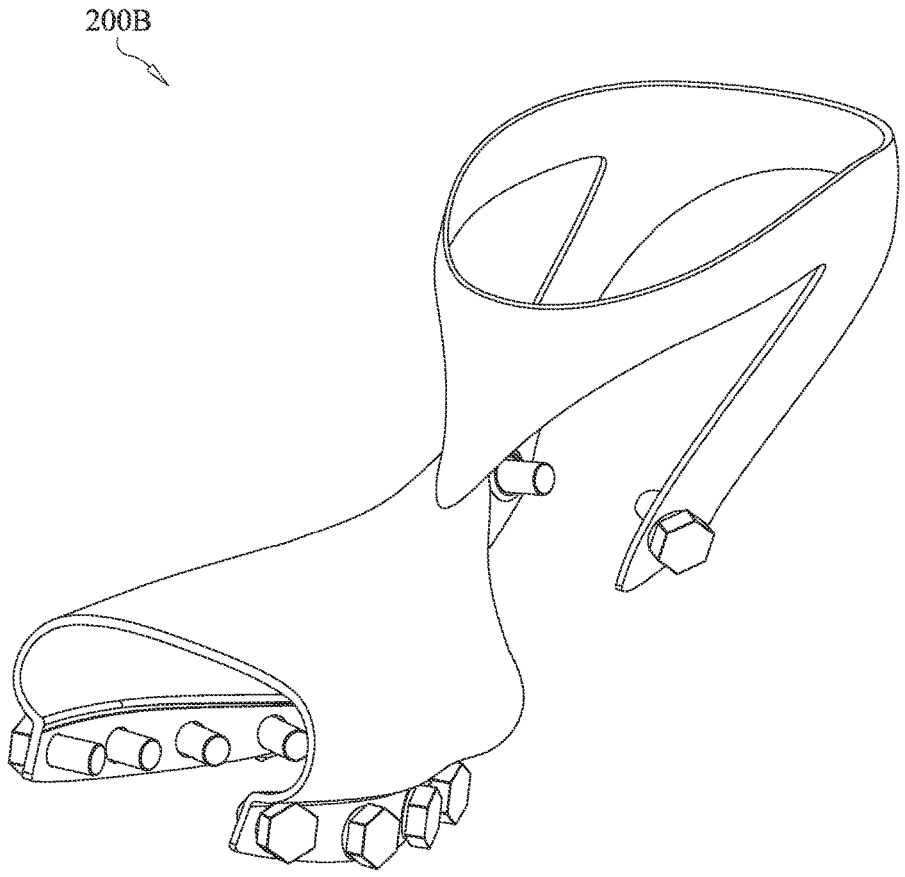
Figure 20C:
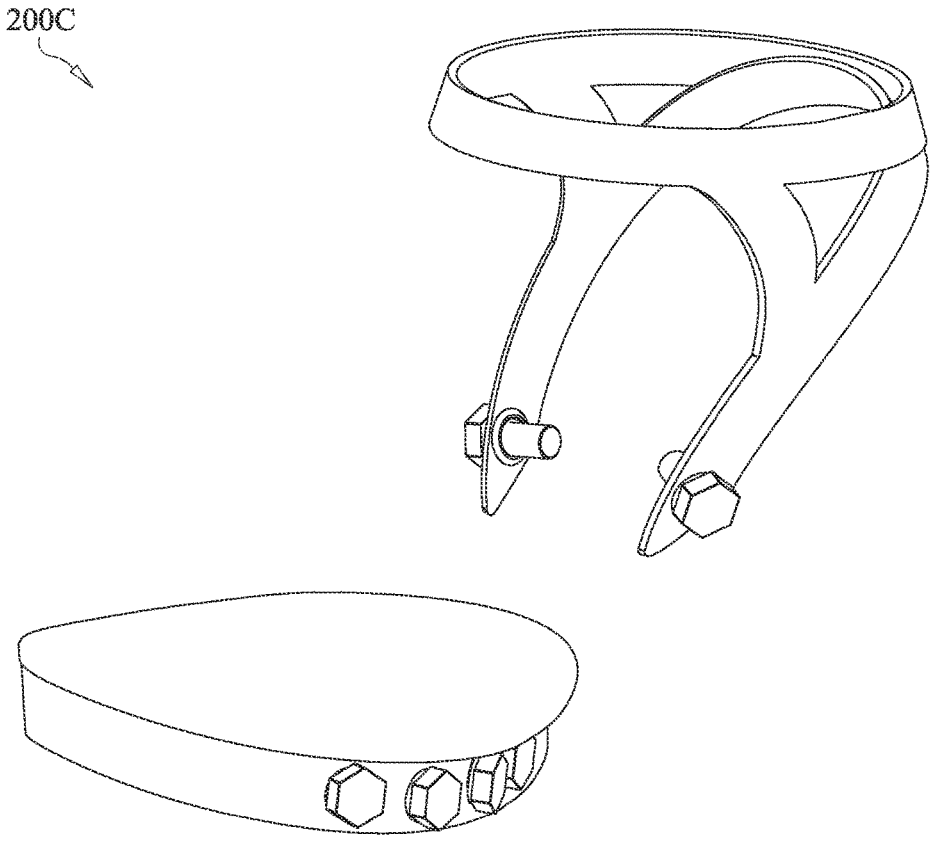
Figure 21A:
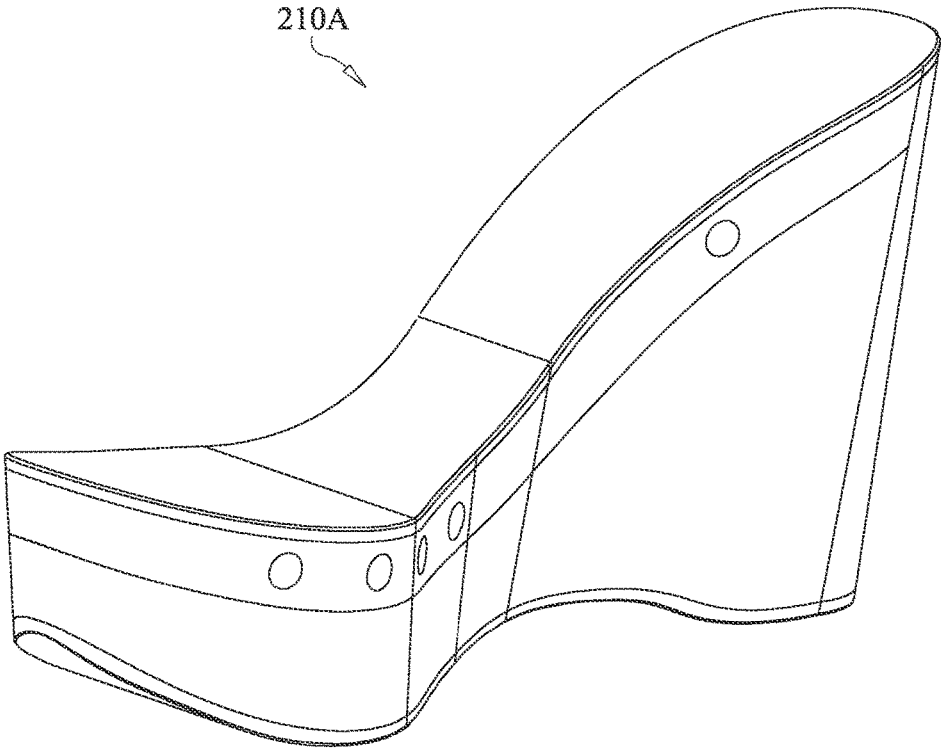
FIGS. 21*a* to 21*c* are front perspective views of three different lower assemblies according to an example embodiment of the present disclosure that are interchangeable with the three different upper assemblies of FIGS. 20*a* to 20*c;*
Figure 21B:
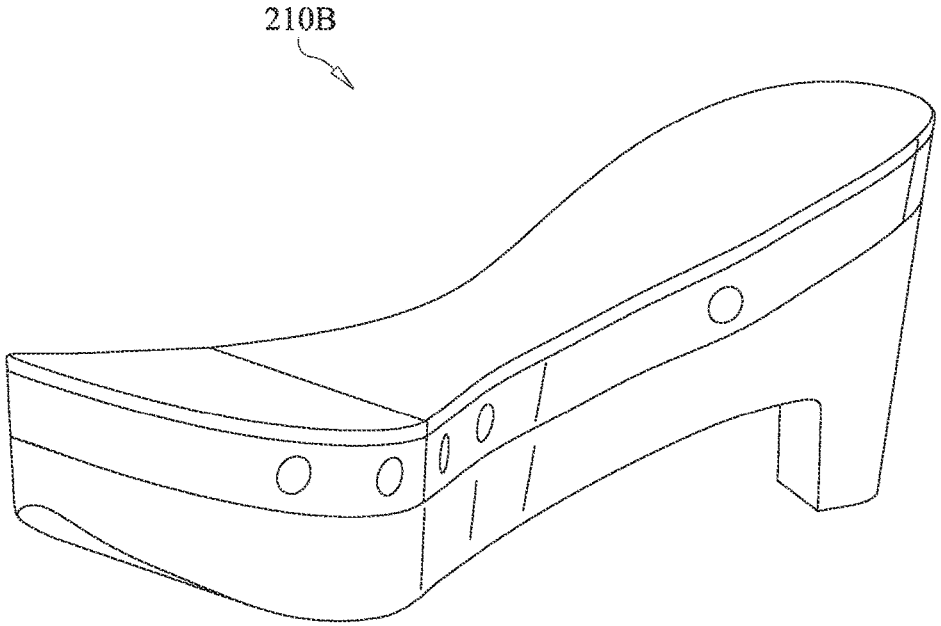
Figure 21C:
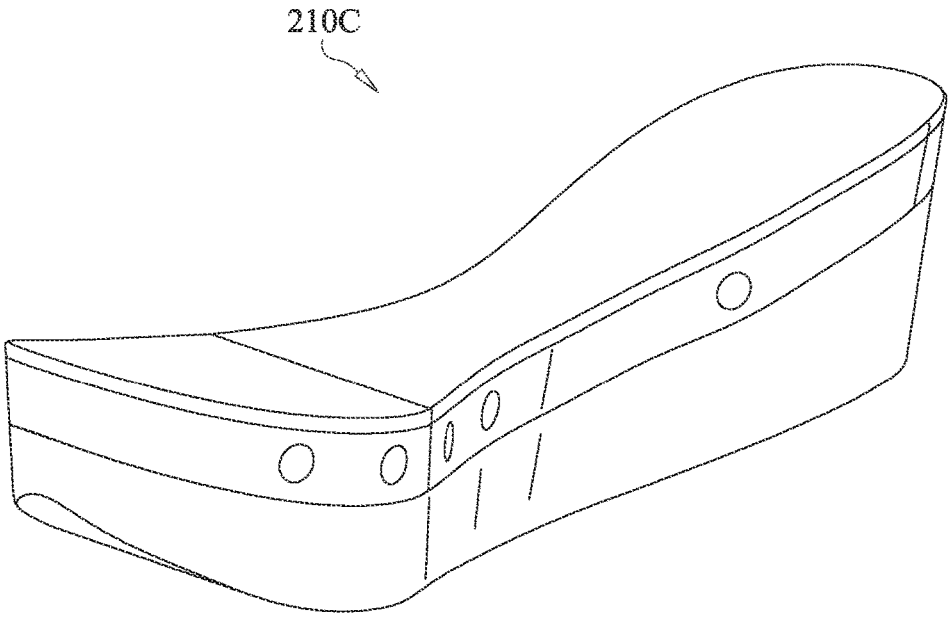

FIGS. 20 and 21 demonstrate the interchangeability of lower assemblies and upper assemblies according to the present disclosure. FIGS. 20*a* to 20*c* show three different upper assemblies 200*a*, 200*b*, 200*c*. FIGS. 21*a* to 21*c* show three different lower assemblies 210*a*, 210*b*, 210*c*. Any of upper assemblies 200*a*, 200*b*, 200*c* can be interchanged with any of lower assemblies 210*a*, 210*b*, 210*c*. By owning essentially three different pairs of shoes, a user can mix and match any of upper assemblies 200*a*, 200*b* and 200*c* with any of lower assemblies 210*a*, 210*b* and 210*c* to create nine different combinations of styles and colors. These nine different styles and colors could be stored in the same space that would normally be required for only three different pairs of shoes. The potential number of combinations increases exponentially as more and more lower assemblies and upper assemblies are stored. Likewise, if a person knew that they needed a high heel for an occasion, but was unsure of the color or style of the high heel needed, the person could store a single lower assembly and a plurality of upper assemblies. If the upper assemblies were simply straps of different colors and styles, the person would only need slightly more storage space than would be required for a single pair of shoes. The present disclosure therefore allows a person to customize their shoes while decreasing the cost and storage space required for the shoes. Likewise, if an upper assembly breaks, the person can simply replace the upper assembly without have to discard the entire shoe.

Figure 22:
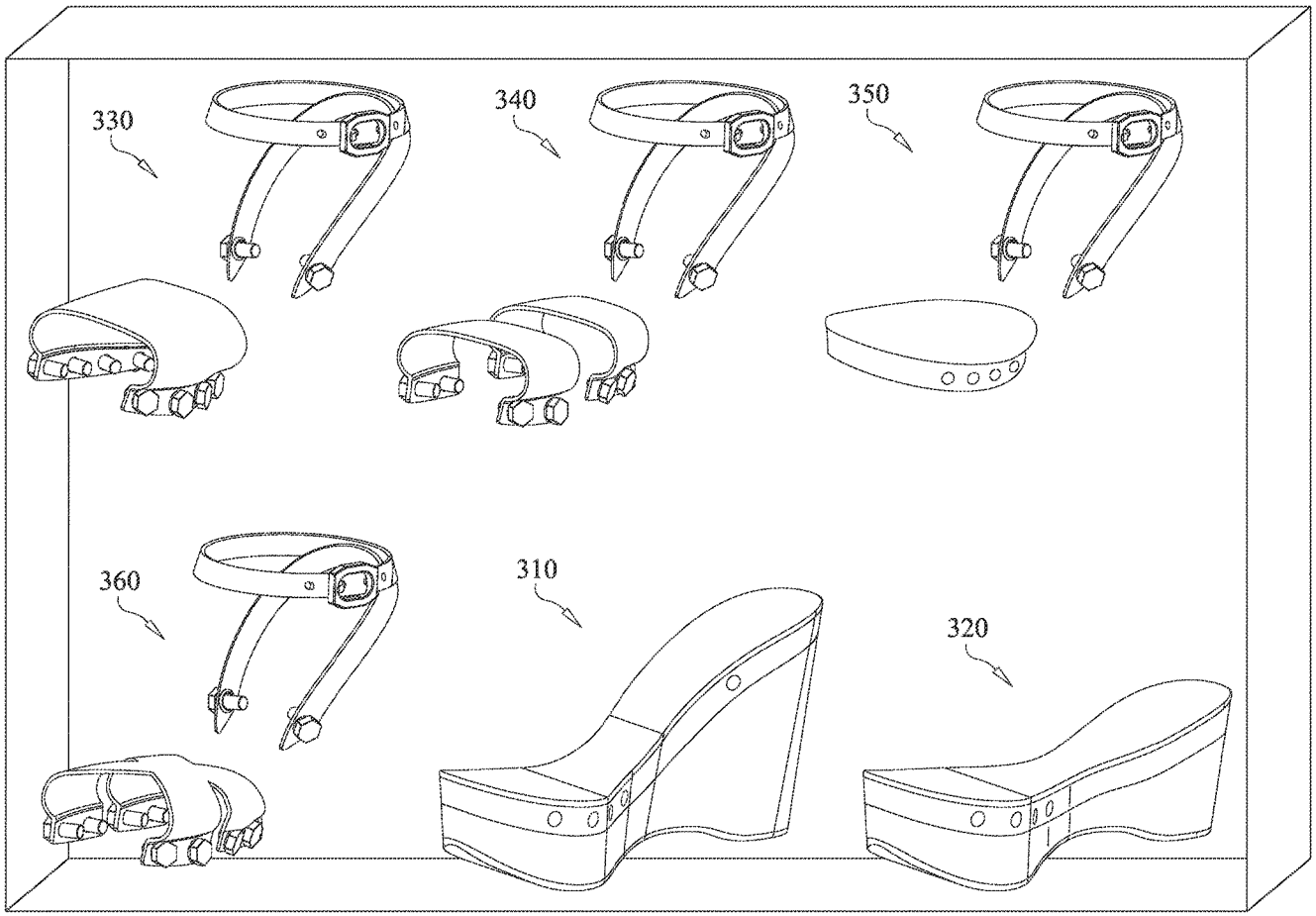
FIG. 22 is a front perspective view of a kit according to an example embodiment of the present disclosure.

FIG. 22 illustrates an example of a kit 300 according to the present disclosure. Kit 300 includes two lower assemblies 310, 320 and four upper assemblies 330, 340, 350, 360. Similar to the example embodiments shown in FIGS. 20 and 21, each of the strap assemblies 330, 340, 350, 360 are interchangeable with each of the lower assemblies 310, 320, giving a purchaser of the kit eight different lower assembly/upper assembly combinations to choose from. That is, each of the upper assemblies can be magnetically attached to each of the lower assemblies using the fasteners discussed above. Kit 300 is advantageous in that a consumer can purchase a single kit that provides the consumer with multiple lower assembly/strap assembly combination options to choose from. Alternatively, interchangeable lower assemblies and strap assemblies can be purchased separately by a consumer. Those of ordinary skill will understand that a kit according to the present disclosure can have any number of lower assemblies and strap assemblies to give the purchaser more than one lower assembly/strap assembly combination option to choose from.

Modifications in addition to those described above may be made to the structures and techniques described herein without departing from the spirit and scope of the disclosure. Accordingly, although specific embodiments have been described, these are examples only and are not limiting on the scope of the disclosure.

Additional Aspects of the Present Disclosure

Aspects of the subject matter described herein may be useful alone or in combination with any one or more of the other aspect described herein. Without limiting the foregoing description, in a first aspect of the present disclosure, an article of footwear includes a lower assembly including at least one first fastener, and an upper assembly including at least one second fastener, at least one of the first fastener and the second fastener including a magnet, wherein the second fastener is positioned and arranged to be inserted into the lower assembly and to magnetically attach to the first fastener when inserted into the lower assembly so as to removably attach the upper assembly to the lower assembly.

In accordance with a second aspect of the present disclosure, which may be used in combination with any other aspect or combination of aspects listed herein, the at least one first fastener is located inside of the lower assembly.

In accordance with a third aspect of the present disclosure, which may be used in combination with any other aspect or combination of aspects listed herein, the at least one first fastener includes the magnet, and the at least one second fastener includes a ferromagnetic material magnetically attracted to the magnet.

In accordance with a fourth aspect of the present disclosure, which may be used in combination with any other aspect or combination of aspects listed herein, the at least one second fastener is positioned and arranged to be inserted into a clearance aperture in the lower assembly to magnetically attach to the first fastener so as to removably attach the upper assembly to the lower assembly.

In accordance with a fifth aspect of the present disclosure, which may be used in combination with any other aspect or combination of aspects listed herein, the at least one second fastener includes a pin.

In accordance with a sixth aspect of the present disclosure, which may be used in combination with any other aspect or combination of aspects listed herein, the at least one first fastener includes a sleeve.

In accordance with a seventh aspect of the present disclosure, which may be used in combination with any other aspect or combination of aspects listed herein, the lower assembly includes a mid-sole layer, the at least one first fastener of the lower assembly is located inside of the mid-sole layer, and the lower assembly further includes at least one of an outer sole layer, a lower layer, and a sock layer.

In accordance with an eighth aspect of the present disclosure, which may be used in combination with any other aspect or combination of aspects listed herein, the upper assembly includes a toe strap and an ankle strap.

In accordance with a ninth aspect of the present disclosure, which may be used in combination with any other aspect or combination of aspects listed herein, the at least one first fastener includes a keyhole and the at least one second fastener includes a twist and lock feature.

In accordance with a tenth aspect of the present disclosure, which may be used in combination with any other aspect or combination of aspects listed herein, the at least one second fastener includes an L-shaped bracket.

In accordance with an eleventh aspect of the present disclosure, which may be used in combination with any other aspect or combination of aspects listed herein, the lower assembly includes a plurality of first fasteners located inside of the lower assembly, and the upper assembly includes a plurality of second fasteners, each second fastener positioned and arranged to be inserted into the lower assembly and to magnetically attach to a corresponding first fastener so as to removably attach the upper assembly to the lower assembly.

In accordance with a twelfth aspect of the present disclosure, which may be used in combination with any other aspect or combination of aspects listed herein, the at least one second fastener includes a plurality of pins positioned and arranged to be inserted into a plurality of clearance apertures in the lower assembly.

In accordance with a thirteenth aspect of the present disclosure, which may be used in combination with any other aspect or combination of aspects listed herein, the article of footwear further includes a second lower assembly including at least one third fastener and a second upper assembly including at least one fourth fastener, the second fastener is positioned and arranged to magnetically attach to the first or third fasteners so as to removably attach the first upper assembly to either of the first and second lower assemblies, and the fourth fastener is also positioned and arranged to magnetically attach to the first or third fasteners so as to removably attach the second upper assembly to either of the first and second lower assemblies.

In accordance with a fourteenth aspect of the present disclosure, which may be used in combination with any other aspect or combination of aspects listed herein, the magnet is a rare earth magnet.

In accordance with a fifteenth aspect of the present disclosure, which may be used in combination with any other aspect or combination of aspects listed herein, the at least one second fastener is at least one pin that is inserted through at least one aperture of the upper assembly and into at least one clearance aperture of the lower assembly.

In accordance with a sixteenth aspect of the present disclosure, which may be used in combination with any other aspect or combination of aspects listed herein, the at least one first fastener is located on an outer surface of the lower assembly.

In accordance with a seventeenth aspect of the present disclosure, which may be used in combination with any other aspect or combination of aspects listed herein, an article of footwear includes a lower assembly including at least one magnet, and an upper assembly including at least one pin, the pin positioned and arranged to be inserted into the lower assembly and held in place in the lower assembly by a magnetic force provided by the magnet.

In accordance with an eighteenth aspect of the present disclosure, which may be used in combination with any other aspect or combination of aspects listed herein, the at least one pin is positioned and arranged to be inserted into at least one clearance aperture in the lower assembly.

In accordance with a nineteenth aspect of the present disclosure, which may be used in combination with any other aspect or combination of aspects listed herein, the at least one pin includes a plurality of pins positioned and arranged to be inserted into a plurality of clearance apertures in the lower assembly.

In accordance with a twentieth aspect of the present disclosure, which may be used in combination with any other aspect or combination of aspects listed herein, the plurality of pins are connected to a single fastener.

In accordance with a twenty-first aspect of the present disclosure, which may be used in combination with any other aspect or combination of aspects listed herein, the at least one pin is part of an L-shaped bracket.

In accordance with a twenty-second aspect of the present disclosure, which may be used in combination with any other aspect or combination of aspects listed herein, the at least one magnet is located inside of the lower assembly.

In accordance with a twenty-third aspect of the present disclosure, which may be used in combination with any other aspect or combination of aspects listed herein, the at least one magnet is located on an outer surface of the lower assembly.

In accordance with a twenty-fourth aspect of the present disclosure, which may be used in combination with any other aspect or combination of aspects listed herein, a method of preparing an article of footwear to be worn includes selecting a lower assembly, the lower assembly including at least one magnet, selecting an upper assembly, the upper assembly including at least one pin, and inserting the pin into a clearance aperture in the lower assembly so as to removably attach the upper assembly to the lower assembly using a magnetic force provided by the magnet.

In accordance with a twenty-fifth aspect of the present disclosure, which may be used in combination with any other aspect or combination of aspects listed herein, selecting the lower assembly includes selecting the lower assembly from a plurality of lower assemblies, the plurality of lower assemblies including at least two lower assemblies that differ aesthetically.

In accordance with a twenty-sixth aspect of the present disclosure, which may be used in combination with any other aspect or combination of aspects listed herein, selecting the upper assembly includes selecting the upper assembly from a plurality of upper assemblies, the plurality of upper assemblies including at least two upper assemblies that differ aesthetically.

In accordance with a twenty-seventh aspect of the present disclosure, which may be used in combination with any other aspect or combination of aspects listed herein, the method of preparing an article of footwear to be worn includes removing the pin of the selected upper assembly from the clearance aperture of the selected lower assembly and inserting the pin of the selected upper assembly into a second clearance aperture of a second lower assembly using a magnetic force provided by a magnet of the second lower assembly.

In accordance with a twenty-eighth aspect of the present disclosure, which may be used in combination with any other aspect or combination of aspects listed herein, the method of preparing an article of footwear to be worn includes removing the pin of the selected upper assembly from the clearance aperture of the selected lower assembly and inserting a second pin of a second upper assembly into the clearance aperture of the selected lower assembly using the magnetic force provided by the magnet.

In accordance with a twenty-ninth aspect of the present disclosure, which may be used in combination with any other aspect or combination of aspects listed herein, an article of manufacture includes a lower assembly including at least one magnet and at least one clearance aperture, a first upper assembly including at least one first aperture, a second upper assembly including at least one second aperture, at least one pin, the pin capable of being (1) inserted through the at least one first aperture and the at least one clearance aperture to removably attach the first upper assembly to the lower assembly using a magnetic force provided by the magnet and (2) inserted through the at least one second aperture and the at least one clearance aperture to removably attach the second upper assembly to the lower assembly using the magnetic force provided by the magnet, and a unifying container containing the lower assembly, the first upper assembly and the second upper assembly.

In accordance with a thirtieth aspect of the present disclosure, which may be used in combination with any other aspect or combination of aspects listed herein, the at least one pin is a plurality of pins connected to a single fastener.

In accordance with a thirty-first aspect of the present disclosure, which may be used in combination with any other aspect or combination of aspects listed herein, the at least one magnet is located inside of the lower assembly.

In accordance with a thirty-second aspect of the present disclosure, which may be used in combination with any other aspect or combination of aspects listed herein, the at least one magnet is located on an outer surface of the lower assembly.

In accordance with a thirty-third aspect of the present disclosure, which may be used in combination with any other aspect or combination of aspects listed herein, an article of manufacture includes a lower assembly including at least one magnet and at least one clearance aperture, a first upper assembly including at least one first pin, a second upper assembly including at least one second pin, wherein the at least one first pin is positioned and arranged to be inserted into the at least one clearance aperture to removably attach the first upper assembly to the lower assembly using a magnetic force provided by the magnet, and wherein the at least one second pin is positioned and arranged to be inserted into the at least one clearance aperture to removably attach the first upper assembly to the lower assembly using a magnetic force provided by the magnet, and a unifying container containing the lower assembly, the first upper assembly and the second upper assembly.

In accordance with a thirty-fourth aspect of the present disclosure, which may be used in combination with any other aspect or combination of aspects listed herein, an article of footwear includes a lower assembly, an upper assembly, at least one fastener for removably attaching the upper assembly to the lower assembly, means for inserting at least a portion of the at least one fastener into the lower assembly, and means for magnetically attaching the at least one fastener to the lower assembly.

In accordance with a thirty-fifth aspect of the present disclosure, which may be used in combination with any other aspect or combination of aspects listed herein, the at least one fastener includes a magnet.

In accordance with a thirty-sixth aspect of the present disclosure, which may be used in combination with any other aspect or combination of aspects listed herein, the lower assembly includes a magnet.

In accordance with a thirty-seventh aspect of the present disclosure, which may be used in combination with any other aspect or combination of aspects listed herein, the article of footwear includes a means for attaching the at least one fastener to the upper assembly.

In accordance with a thirty-eighth aspect of the present disclosure, which may be used in combination with any other aspect or combination of aspects listed herein, the article of footwear includes a means for locking the fastener into the lower assembly.

In accordance with a thirty-ninth aspect of the present disclosure, which may be used in combination with any other aspect or combination of aspects listed herein, the at least one fastener is integrally formed with the upper assembly.

In accordance with a fortieth aspect of the present disclosure, which may be used in combination with any other aspect or combination of aspects listed herein, an article of footwear includes an upper assembly including at least one first fastener, wherein the at least one first fastener is positioned and arranged to be inserted into a lower assembly including at least one second fastener, and to magnetically attach to the at least one second fastener when inserted into the lower assembly so as to removably attach the upper assembly to the lower assembly.

The invention is claimed as follows:

1. An article of footwear, comprising:

an upper assembly; and a lower assembly configured to attach to the upper assembly via at least one first fastener, the lower assembly including a first portion including a first inner surface, at least one first side surface and a first outer surface, a second portion including a second inner surface, at least one second side surface and a second outer surface, and at least one second fastener separate from the at least one first fastener, the second inner surface of the second portion placed against the first inner surface of the first portion, the at least one second fastener located in at least one slot in the first inner surface of the first portion of the lower assembly so as to locate the at least one second fastener between the first portion of the lower assembly and the second portion of the lower assembly, wherein the at least one second fastener is configured to magnetically attach to the at least one first fastener when the at least one first fastener is inserted into at least one clearance aperture formed at least in part through the at least one first side surface of the first portion of the lower assembly so as to removably attach the upper assembly to the lower assembly, and wherein the at least one first fastener includes a body portion and a head portion, the body portion including a first end with a first diameter and a second end with a second diameter larger than the first diameter, wherein a gap is located between the second end and the head portion.

2. The article of footwear of claim 1, wherein the at least one second fastener is located at an inside end of the at least one clearance aperture of the lower assembly.

3. The article of footwear of claim 1, wherein the at least one second fastener includes a magnet, and wherein the at least one first fastener includes a material magnetically attracted to the magnet.

4. The article of footwear of claim 1, wherein the head portion of the at least one first fastener can removably attach to the body portion of the at least one first fastener.

5. The article of footwear of claim 1, wherein the at least one second fastener includes a sleeve.

6. The article of footwear of claim 1, wherein the first portion of the lower assembly forms at least a portion of a mid-sole layer, the at least one second fastener of the lower assembly is located inside of the mid-sole layer, and the lower assembly further includes at least one of an outer sole layer, a lower layer, and a sock layer.

7. The article of footwear of claim 1, wherein the second end of the body portion contacts the at least one first side surface of the lower assembly when the first end slides into the at least one clearance aperture when attaching the lower assembly to the upper assembly.

8. The article of footwear of claim 1, wherein the first inner surface of the first portion is an upper surface of the first portion, and wherein the second inner surface of the second portion is a lower surface of the second portion.

9. The article of footwear of claim 1, further including a second lower assembly including at least one third fastener and a second upper assembly including at least one fourth fastener, wherein the first fastener is configured to magnetically attach to the second or third fasteners so as to removably attach the upper assembly to either of the lower assembly and the second lower assembly, and wherein the fourth fastener is also configured to magnetically attach to the second or third fasteners so as to removably attach the second upper assembly to either of the lower assembly and the second lower assembly.

10. An article of footwear, comprising:

a lower assembly including at least one magnet located inside of the lower assembly, wherein the lower assembly includes a first portion having a first inner surface, at least one first side surface and a first outer surface, and a second portion having a second inner surface, at least one second side surface and a second outer surface, the second inner surface of the second portion placed against the first inner surface of the first portion, wherein the at least one magnet is located in a slot in the first inner surface of the first portion so as to locate the at least one magnet between the first portion of the lower assembly and the second portion of the lower assembly; and an upper assembly including at least one pin, the at least one pin including a body portion and a head portion, the body portion including a first end with a first diameter and a second end with a second diameter larger than the first diameter, wherein a gap is located between the second end and the head portion, the first end of the body portion of the at least one pin positioned and arranged to be inserted into at least one clearance aperture in an outer surface of the lower assembly so that the second end of the body portion contacts the outer surface of the lower assembly when attaching the lower assembly to the upper assembly, the at least one pin held in place in the lower assembly by a magnetic force provided by the magnet, wherein the at least one magnet is separate from the at least one pin and the upper assembly and located inside of the lower assembly prior to attachment of the upper assembly to the lower assembly, and wherein the at least one clearance aperture is formed at least in part through the at least one first side surface of the first portion.

11. The article of footwear of claim 10, wherein the first portion of the lower assembly is a separate piece from the second portion of the lower assembly.

12. The article of footwear of claim 10, wherein the at least one magnet applies a horizontal pulling force against the at least one pin, and the at least one clearance aperture holds the at least one pin in place when a vertical force is applied against the at least one pin.

13. An article of footwear, comprising:

a lower assembly;

an upper assembly;

the upper assembly including at least one first fastener for removably attaching the upper assembly to the lower assembly, wherein the at least one first fastener includes a body portion and a head portion, the body portion including a first end with a first diameter and a second end with a second diameter larger than the first diameter, wherein a gap is located between the second end and the head portion; and the lower assembly including (i) a first portion including a first inner surface, at least one first side surface and a first outer surface, (ii) a second portion including a second inner surface, at least one second side surface and a second outer surface, the second inner surface of the second portion placed against the first inner surface of the first portion, (iii) at least one aperture formed at least in part through the at least one first side surface of the first portion and configured to receive at least a portion of the at least one first fastener into the lower assembly, and (iv) at least one second fastener located within the lower assembly prior to attachment of the upper assembly to the lower assembly, wherein the at least one second fastener is located in at least one slot in the first inner surface of the first portion of the lower assembly so as to locate the at least one second fastener between the first portion of the lower assembly and the second portion of the lower assembly, and wherein the at least one second fastener is configured to magnetically attach the at least one first fastener to the lower assembly, and wherein the second end of the body portion contacts the at least one first side surface of the lower assembly when the first end slides into the aperture in the lower assembly when attaching the lower assembly to the upper assembly.

14. The article of footwear of claim 13, wherein the at least one second fastener includes a magnet.

15. The article of footwear of claim 13, wherein the first portion of the lower assembly is a separate piece from the second portion of the lower assembly.

16. The article of footwear of claim 13, wherein the at least one second fastener applies a horizontal pulling force against the at least one first fastener, and the at least one aperture holds the at least one first fastener in place when a vertical force is applied against the at least one first fastener.

17. The article of footwear of claim 10, wherein the second end of the body portion directly contacts the outer surface of the lower assembly when attaching the lower assembly to the upper assembly.

* * * * *